US011193308B2

(12) United States Patent
Hsu

(10) Patent No.: US 11,193,308 B2
(45) Date of Patent: Dec. 7, 2021

(54) LATCH CONTROL DEVICE COOPERATING WITH A LOCK

(71) Applicant: I-TEK METAL MFG. CO., LTD, Tainan (TW)

(72) Inventor: Wei-Chung Hsu, Tainan (TW)

(73) Assignee: I-TEK METAL MFG. CO., LTD., Tainan (TW)

( * ) Notice: Subject to any disclaimer, the term of this patent is extended or adjusted under 35 U.S.C. 154(b) by 259 days.

(21) Appl. No.: 16/581,891

(22) Filed: Sep. 25, 2019

(65) Prior Publication Data

US 2021/0054660 A1 Feb. 25, 2021

(30) Foreign Application Priority Data

Aug. 20, 2019 (TW) ..... 108129595

(51) Int. Cl.

| | |
|---|---|
| ***E05B 47/00*** | (2006.01) |
| ***E05B 15/02*** | (2006.01) |
| ***E05B 47/06*** | (2006.01) |
| ***E05B 17/20*** | (2006.01) |

(52) U.S. Cl.

CPC ..... *E05B 47/0047* (2013.01); *E05B 15/022* (2013.01); *E05B 17/2007* (2013.01); *E05B 47/0603* (2013.01); *E05B 2047/0068* (2013.01)

(58) Field of Classification Search

CPC ..... Y10T 292/702; E05B 47/0047; E05B 47/0603; E05B 15/022; E05B 15/21; E05B 17/2007; E05B 2047/0068; E05B 63/244; Y10S 292/53; Y10S 292/54; Y10S 292/60

USPC ..... 292/340, 341.15, 341.16; 70/278.7, 70/279.1, 432; 411/410

See application file for complete search history.

(56) References Cited

U.S. PATENT DOCUMENTS 1,919,739 A * 7/1933 Minzenmayer ..... E05B 17/2003 292/346
3,967,080 A * 6/1976 Errani ..... G08B 13/08 200/61.64
4,026,589 A * 5/1977 Hanchett, Jr. ..... E05B 47/0047 292/341.16

(Continued)

FOREIGN PATENT DOCUMENTS

DE 3942379 A1 * 7/1990 ..... E05B 47/0047
DE 20320274 U1 * 4/2004 ..... E05B 65/104

(Continued)

*Primary Examiner* — Kristina R Fulton
*Assistant Examiner* — Steven A Tullia
(74) *Attorney, Agent, or Firm* — Alan D. Kamrath; Karin L. Williams; Mayer & Williams PC

(57) ABSTRACT

A latch control device includes a mounting seat and a locking cap device pivotably mounted to the mounting seat and pivotable relative to the mounting seat between a closure position and a non-closure position. Optionally mounted to the latch control device are a first accessory, a second accessory, a third accessory, a first escutcheon, and a second escutcheon. The latch control device is selectively assembled into a first mode (including a detecting device), a second mode (including the detecting device, the first accessory, and the third accessory), or a third mode (including the detecting device, the first accessory, and the second accessory) for cooperating with a cylindrical latch device, a first box type latch device, or a second box type latch device.

4 Claims, 22 Drawing Sheets

(56) References Cited

U.S. PATENT DOCUMENTS 4,595,220 A * 6/1986 Hanchett, Jr. ..... E05B 47/0047 292/341.16
5,118,150 A * 6/1992 Jarrett ..... E05B 47/0047 292/341.16
5,257,841 A * 11/1993 Geringer ..... E05B 45/083 292/340
5,484,180 A * 1/1996 Helmar ..... E05B 47/0047 292/201
5,713,705 A * 2/1998 Grunbichler ..... F16B 31/021 411/5
5,735,559 A * 4/1998 Frolov ..... E05B 47/0047 292/210
5,757,269 A * 5/1998 Roth ..... E05B 45/083 200/61.68
6,020,816 A * 2/2000 Agozzino ..... E05B 45/086 340/542
6,325,429 B1 * 12/2001 Oxley ..... E05B 47/0047 292/341.16
6,580,355 B1 * 6/2003 Milo ..... E05B 17/0062 292/340
7,273,241 B2 * 9/2007 Milo ..... E05B 17/2003 292/346
7,540,699 B2 * 6/2009 Selle ..... E06B 1/70 411/435
7,669,902 B2 * 3/2010 Orbeta ..... E05B 17/0062 292/340
9,850,684 B2 * 12/2017 Vasudevan ..... E05B 17/22
2002/0029526 A1 * 3/2002 Kiernan ..... E05B 47/0047 49/503
2002/0163210 A1 * 11/2002 Galindo ..... E05B 47/0047 292/341.16
2008/0084299 A1 * 4/2008 Fisher ..... E05B 47/02 340/542
2010/0096864 A1 * 4/2010 Webb ..... E05B 47/02 340/542
2011/0241361 A1 * 10/2011 Orbeta ..... E06B 1/70 411/435
2013/0328332 A1 * 12/2013 Scheffler ..... E05B 47/0047 292/341.16
2014/0157672 A1 * 6/2014 Grone ..... E05F 15/70 49/31
2018/0044951 A1 * 2/2018 Wleklinski, III ... E05B 47/0047 292/341.16
2018/0371797 A1 * 12/2018 Talpe ..... E05B 47/0002
2019/0203503 A1 * 7/2019 Chang ..... E05B 17/22

FOREIGN PATENT DOCUMENTS

DE 10326396 B3 * 10/2004 ..... E05B 47/0047
DE 10347528 B3 * 3/2005 ..... E05B 47/0047
DE 102009043962 A1 * 3/2011 ..... E05B 47/0047
EP 0744002 B1 * 7/1998 ..... E05B 15/022
FR 2264948 A1 * 10/1975 ..... E05B 47/0047
GB 2083858 A * 3/1982 ..... E05B 45/086
KR 100761999 B1 * 9/2007 ..... E05B 47/0047
KR 20170009020 A * 1/2017
WO WO-8906732 A1 * 7/1989 ..... E05B 47/0046
WO WO-0231295 A1 * 4/2002 ..... E05B 15/022
WO WO-2016064816 A1 * 4/2016 ..... E05B 17/002
WO WO-2017015718 A1 * 2/2017 ..... E05B 47/0047

* cited by examiner

LATCH CONTROL DEVICE COOPERATING WITH A LOCK

BACKGROUND OF THE INVENTION

The present invention relates to a latch control device and, more particularly, to a modularized latch control device that can be assembled into one of a plurality of different modes for cooperating with different types of latch devices that can be locked or unlocked by the latch control device through electric control.

A lock mounted on a door generally includes a latch device operable by an inner operational device and/or an outer operational device. The type of the latch device can be disposed differently according to different needs or situations. For example, a simple cylindrical latch device includes a retractable latch. A more complicated box type latch device includes a retractable latch and an anti-pick bolt. A further more complicated box type latch device includes a retractable latch, an anti-pick bolt, and a locking latch providing a secondary locking function. The latch, the anti-pick latch, and the locking latch can be arranged in different sequences or have different sizes. Thus, the door frame must include at least one latch hole to cooperate with the cylindrical latch device or the box type latch device. Furthermore, the cylindrical latch device or the box type latch device are generally mechanical type that must be replaced if the door is intended to provide electric lock functions.

Thus, a need exists for a novel latch control device that can be assembled into one of a plurality of different modes for cooperating with different types of latch devices.

BRIEF SUMMARY OF THE INVENTION

A latch control device according to the present invention includes:

a mounting seat including a first side, a second side opposite to the first side, and a front face extending between the first side and the second side, wherein the mounting seat further includes a first compartment having a first opening in the front face and a second opening in the first side, and wherein the mounting seat further includes a track formed on the second side and intercommunicating with the first compartment;

a locking cap device pivotably connected to the mounting seat and fixably mounted to the mounting seat, wherein when the locking cap device is not fixed, the locking cap device is pivotable relative to the mounting seat between a closure position closing the second opening and a non-closure position not closing the second opening, and wherein when the locking cap device is fixed, the locking cap device is not pivotable from the closure position to the non-closure position;

a detecting device configured to detect whether a door is closed, wherein the detecting device includes a supporting seat, wherein the supporting seat includes an engaging portion and a sliding portion protruding from the engaging portion, wherein the sliding portion includes a screw hole, wherein the detecting device is received in the first compartment, and wherein the sliding portion is received in the track; and at least one fixing screw including a head and a shank, wherein the shank extends from the head and has an outer thread on an outer periphery thereof, wherein the head includes a first driving hole having non-circular cross sections, wherein the shank includes an end face having a second driving hole with non-circular cross sections, wherein the shank of the at least one fixing screw extends through the track and is in threading connection with the screw hole of the supporting seat, wherein when the locking cap device is in the closure position, the at least one fixing screw is prevented from being rotated by the second driving hole, wherein when the locking cap device is in the non-closure position, the at least one fixing screw is permitted to rotate by the second driving hole, wherein when the at least one fixing screw is tightened, the detecting device is fixed and not movable along the track, and wherein when the at least one fixing screw is loosened, the detecting device is movable along the track.

In the latch control device according to the present invention, by using the fixing screws having the second driving holes, the fixing screws can be fixed by engaging a hand tool with the second driving hole of each fixing screw. Thus, the positions of the detecting device, the first accessory, the second accessory, and the third accessory can be rapidly adjusted without detaching the latch control device from the door, and the positions of the detecting device, the first accessory, the second accessory, and the third accessory can be fixed in place after tightening the screw holes, providing excellent adjusting convenience during installation.

In an example, the latch control device further includes:

a first accessory including opposite first and second sides, wherein a first sliding block is formed on the first side of the first accessory and includes a first threaded hole, wherein a first through-hole is defined in the second side of the first accessory and is aligned with the first threaded hole of the first accessory;

a second accessory including a second sliding block on a wall thereof, wherein the second sliding block includes a second threaded hole, wherein the second accessory further includes a second through-hole defined in another wall of the second accessory opposite to the second sliding block, and wherein the second threaded hole is aligned with the second threaded hole of the second accessory;

a third accessory including a third sliding block on a wall thereof, wherein the third sliding block includes a third threaded hole, wherein the third accessory further includes a third through-hole defined in another wall of the third accessory opposite to the third sliding block, and wherein the third threaded hole is aligned with the third threaded hole of the third accessory, wherein the at least one fixing screw includes a first fixing screw, a second fixing screw, and a third fixing screw, wherein the latch control device is selectively assembled into a first mode, a second mode, or a third mode to cooperate with a cylindrical latch device with a latch, a first box type latch device, or a second box type latch device, wherein the first box type latch device includes a first latch, a locking latch, and a first anti-pick latch operatively connected to the first latch, wherein the first latch is retractable when the first anti-pick latch is in an extended position, wherein the first latch is not retractable when the first anti-pick latch is in a retracted position, wherein the second box type latch device includes a second latch and a second anti-pick latch operatively connected to the second latch, wherein the second latch is retractable when the second anti-pick latch is in a retracted position, wherein the second latch is not retractable when the second anti-pick latch is in a retracted position, wherein when the latch control device is selectively assembled into the first mode, the first, second, and third accessories are not assembled, the latch of the cylindrical latch device is received in the first compartment of the mounting seat, wherein when the lock cap device is locked, the latch of the cylindrical latch device is prevented from disengaging from the first compartment, wherein when the locking cap device is unlocked, the latch head of the cylindrical latch device is operable to pivot the locking cap device from the closure position to the non-closure position and disengages from the first chamber, and wherein when the latch is in the first compartment, the detecting device detects the door is in the closed position, wherein when the latch control device is selectively assembled into the second mode, the first and third accessories are selected and mounted in the first compartment, the first sliding block of the first accessory and the third sliding block of the third accessory are received in the track, wherein the shank of the first fixing screw extends through the track and engages with the first threaded hole of the first accessory, wherein the shank of the third fixing screw extends through the track and engages with the third threaded hole of the third accessory, wherein the first accessory and the third accessory fill two portions of the first compartment, respectively, wherein the first compartment receives the first latch of the first box type latch device, wherein the first accessory is configured to press against and retract the first anti-pick latch, wherein when the locking cap device is locked, the first latch of the first box type latch device is prevented from disengaging from the first compartment, wherein when the locking cap device is unlocked, the first latch of the first box type latch device is operable to push the locking cap device to pivot from the closure position to the non-closure position and disengages from the first compartment, wherein when the locking cap device is in the closure position, the first and third fixing screws are prevented from being rotated by the second driving holes, wherein when the locking cap device is in the non-closure position, the first and third fixing screws are rotatable by using the second driving holes, wherein when the first and third fixing screws are tightened, the first and third accessories are fixed and, thus, not movable along the track, wherein when the first fixing screw is loosened, the first accessory is movable along the track, and wherein when the third fixing screw is loosened, the third accessory is movable along the track, wherein when the latch control device is selectively assembled into the third mode, the first and second accessories are selected and mounted in the mounting seat, wherein the first accessory blocks a portion of the first compartment, wherein the second accessory defines a locking latch hole, wherein the first sliding block of the first accessory and the second sliding block of the second accessory are received in the track, wherein the shank of the first fixing screw extends through the track and engages with the first threaded hole of the first accessory, wherein the shank of the second fixing screw extends through the track and engages with the second threaded hole of the second accessory, wherein the first compartment receives the second latch of the second box type latch device, wherein the first accessory is configured to press against and retract the second anti-pick latch, wherein the locking latch hole of the second accessory receives the locking latch of the second box type latch device, wherein when the locking cap device is locked, the second latch of the second box type latch device is prevented from disengaging from the first compartment, wherein when the locking cap device is unlocked and when the locking latch is located inside of the locking latch hole of the second accessory, the second latch of the second box type latch device is prevented from disengaging from the first compartment, wherein when the locking cap device is unlocked and when the locking latch is located outside of the locking latch hole of the second accessory, the second latch of the second box type latch device is operable to push the locking cap device to pivot from the closure position to the non-closure position and disengages from the first compartment, wherein when the locking cap device is in the closure position, the first and second fixing screws are prevented from rotating by using the second driving holes, wherein when the locking cap device is in the non-closure position, the first and third fixing screws are rotatable by using the second driving holes, wherein when the first and second fixing screws are tightened, the first and second accessories are fixed and, thus, not movable along the track, wherein when the first fixing screw is loosened, the first accessory is movable along the track, and wherein when the second fixing screw is loosened, the second accessory is movable along the track.

In an example, the locking cap device further includes:

a locking cap pivotably connected to the mounting seat and including an inner end, an outer end, and an inner surface extending between the inner side and the outer side, wherein the locking cap further includes a first groove defined in the inner surface and a second groove defined in the outer side and extending to the inner surface, a guiding plate including a first face, a second face opposite to the first face, and a guiding groove extending from the first face through the second face, wherein the guiding plate is fixed to the inner face of the locking cap, wherein the second face abuts the inner surface of the locking cap, wherein the guiding plate covers the first groove, wherein a portion of the guiding groove is aligned with a portion of the first groove to form a stepped portion, and wherein the guiding plate covers a side of the second groove to form another stepped portion;

a first lining member including a first coupling portion and a second coupling portion spaced from the first coupling portion, wherein the first lining member includes a first screw hole, a second lining member including a first engaging block and a second engaging block spaced from the first engaging block, and wherein the second lining member further includes a second screw hole, wherein one of the first lining member and the second lining member is selected and mounted, wherein when the first lining member is selected, the first lining member abuts against the first face of the guiding plate, wherein the first coupling portion extends into the guiding groove and engages with the first groove, wherein the second coupling portion extends into the second groove, a tightening screw is threadedly engaged with the first screw hole and presses against the inner surface of the locking cap, wherein when the second lining plate is selected, the second lining plate abuts the first face of the guiding plate, wherein the first engaging block extends into the guiding groove and engages with the first groove, wherein the second engaging block extends into the second groove, the tightening screw is threadedly engaged with the second screw hole and presses against the inner surface of the locking cap, wherein a spacing between an outer surface of the second lining member and the first face of the guiding plate is smaller than a spacing between an outer surface of the first lining member and the first face of the guiding plate.

In an example, the latch control device further includes:

a higher melting point member including an outer end, an inner end, a larger hole section extending from the inner end towards but spaced from the outer end, and a smaller hole section extending from the outer end to the larger hole section, wherein the locking cap further includes a receiving hole in a side thereof, wherein the higher melting point member is securely received in the receiving hole, wherein the mounting seat further includes a pin hole in a side thereof and intercommunicating with the first compartment, wherein the receiving hole is aligned with the pin hole when the locking cap device is in the closure position;

a lower melting point member received in the larger hole section and having a melting point lower than a melting point of the higher melting point member;

a pin movably received in the larger hole section, wherein the pin is stopped by the lower melting point member, and wherein the pin includes a coupling end and an enlarged end larger than the coupling end; and an ejection spring received in the receiving hole, wherein the ejection spring biases the pin towards the pin hole, wherein when the coupling end of the pin is not engaged with the pin hole, the locking cap device is pivotable towards the non-closure position, and wherein when the lower melting point member melts under high heat, the ejection spring moves the coupling end of the pin to pass through the smaller hole section and engages with the pin hole, and the locking cap device is prevented from pivoting towards the non-closure position.

The present invention will become clearer in light of the following detailed description of illustrative embodiments of this invention described in connection with the drawings.

Figure 1:
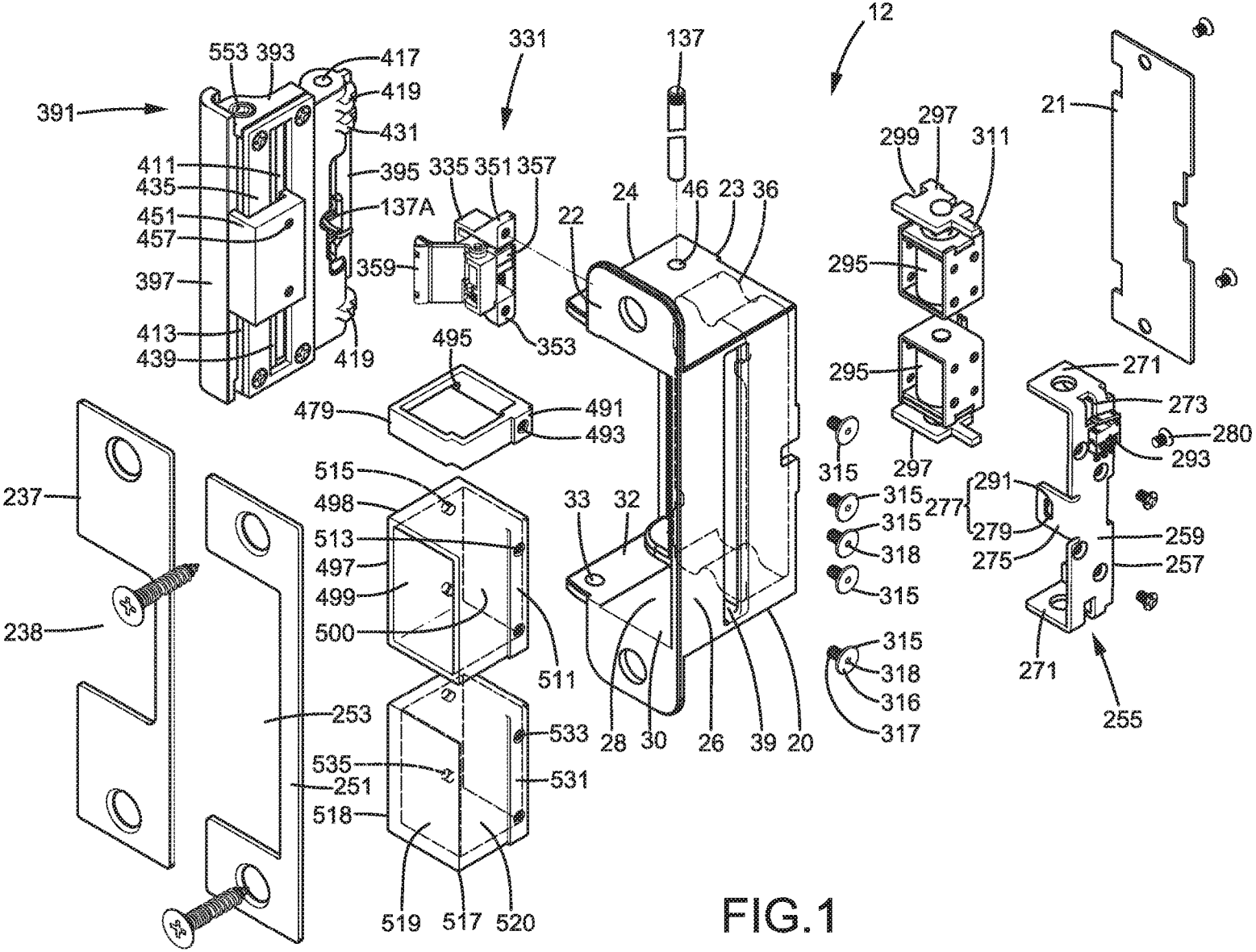
FIG. 1 is an exploded, perspective view of a latch control device according to the present invention.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first". "second", "third", "lower", "upper" "inner", "outer", "side", "end", "portion", "longitudinal", "axial", "thickness", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

With reference to the drawings, a latch control device 12 according to the present invention can be assembled into different modes according to different types of latch devices and can control locking or release of the latches of the latch devices.

The latch control device 12 includes a mounting seat 20 having a front face 22 and a rear face 23 opposite to the front face 22. The mounting seat 20 further includes first and second sides 24 and 26 extending between the front face 22 and the rear face 23 and opposite to each other (FIG. 1). The mounting seat 20 further includes a first compartment 28 extending from the front face 22 towards but spaced from the rear face 23 and a second compartment 36 extending from the rear face 23 to the first compartment 28 to thereby intercommunicate with the first compartment 28. An engaging portion 44 is defined between the first compartment 28 and the second compartment 36. The mounting seat 20 further includes a pivot hole 46 in an intersection of the first compartment 28 and the second compartment 36. The mounting seat 20 further includes a track 39 that is elongated and that extends from the second side 26 to the first compartment 28. The mounting seat 20 further includes a first opening 30 defined in the front face 22 and intercommunicating with the first compartment 28. The mounting seat 20 further includes a second opening 32 defined in the first side 24, contiguous to the first opening 30, and intercommunicating with the first compartment 28. The mounting seat 20 further includes two pin holes 33 located adjacent to the second opening 32 and respectively defined in two wings extending from top and bottom sides thereof. The mounting seat 20 is configured to be mounted on an end face of a door frame (not shown).

Figure 2:
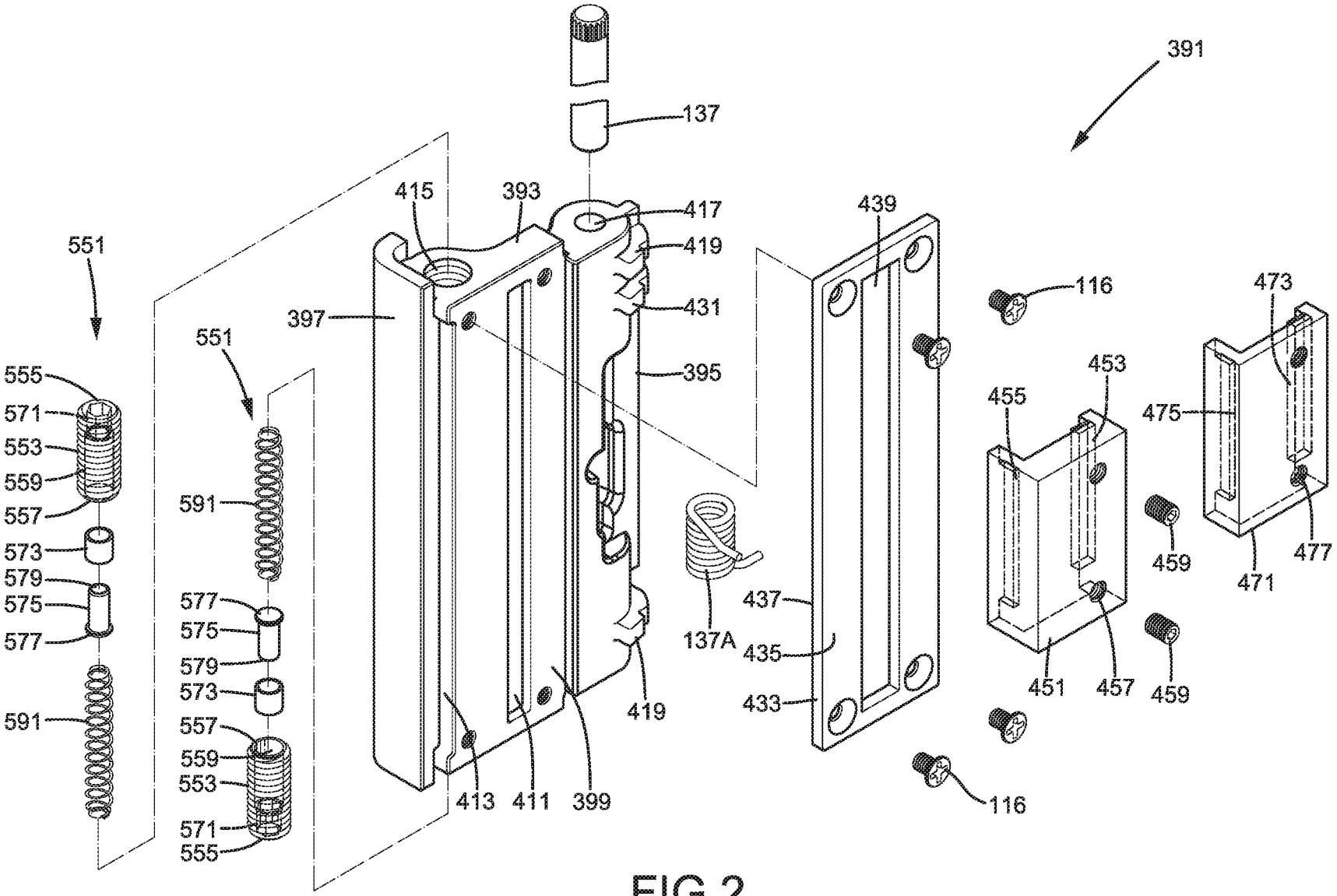
FIG. 2 is an exploded, perspective view of a locking cap device of the latch control device of FIG. 1.

With reference to FIG. 2, the latch control device 12 further includes a locking cap device 391 pivotably connected to the mounting seat 20. The locking cap device 391 includes a locking cap 393 having an outer side 397, an inner side 395, and inner surface 399 extending between the inner side 395 and the outer side 397. A first groove 411 is defined in the inner surface 399 and is elongated. A second groove 413 is defined in the outer side 397. The locking cap 393 further includes two first coupling portions 419 disposed on two ends of an edge of the inner side 395 and arranged in the form of two protrusions in this embodiment. The locking cap 393 further includes a second coupling portion 431 between the two first coupling portions 419. The locking cap 393 further includes a pivotal hole 417 defined in the inner side 395. The locking cap 393 further includes two receiving holes 415 respectively in two end faces adjacent to the outer side 397. Each of the two receiving holes 415 has an inner threading.

Figure 11:
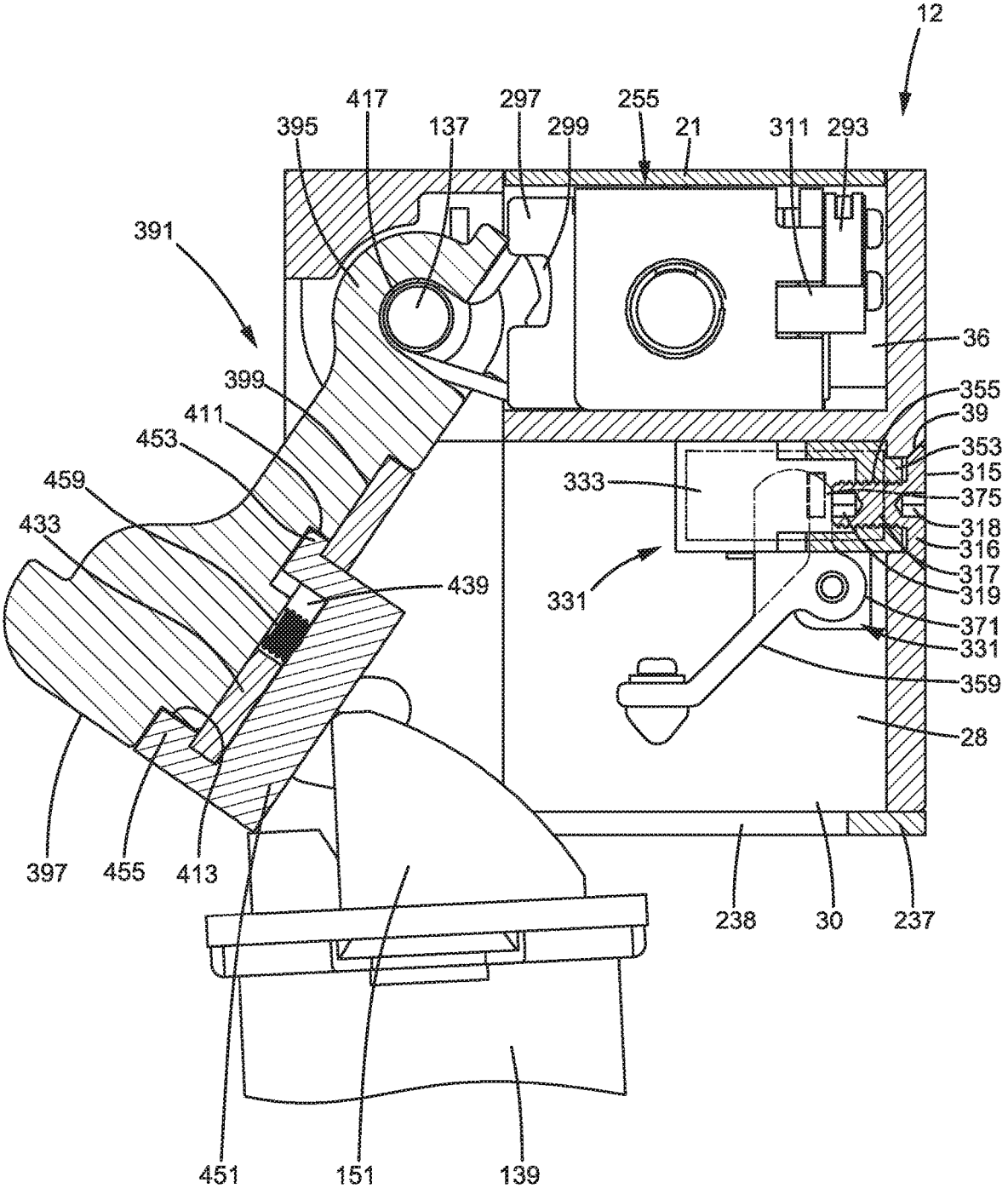
FIG. 11 is a view similar to FIG. 6 with the locking cap device, of the latch control device assembled into a first mode, pushed by the cylindrical latch device to a non-closure position.
Figure 16:
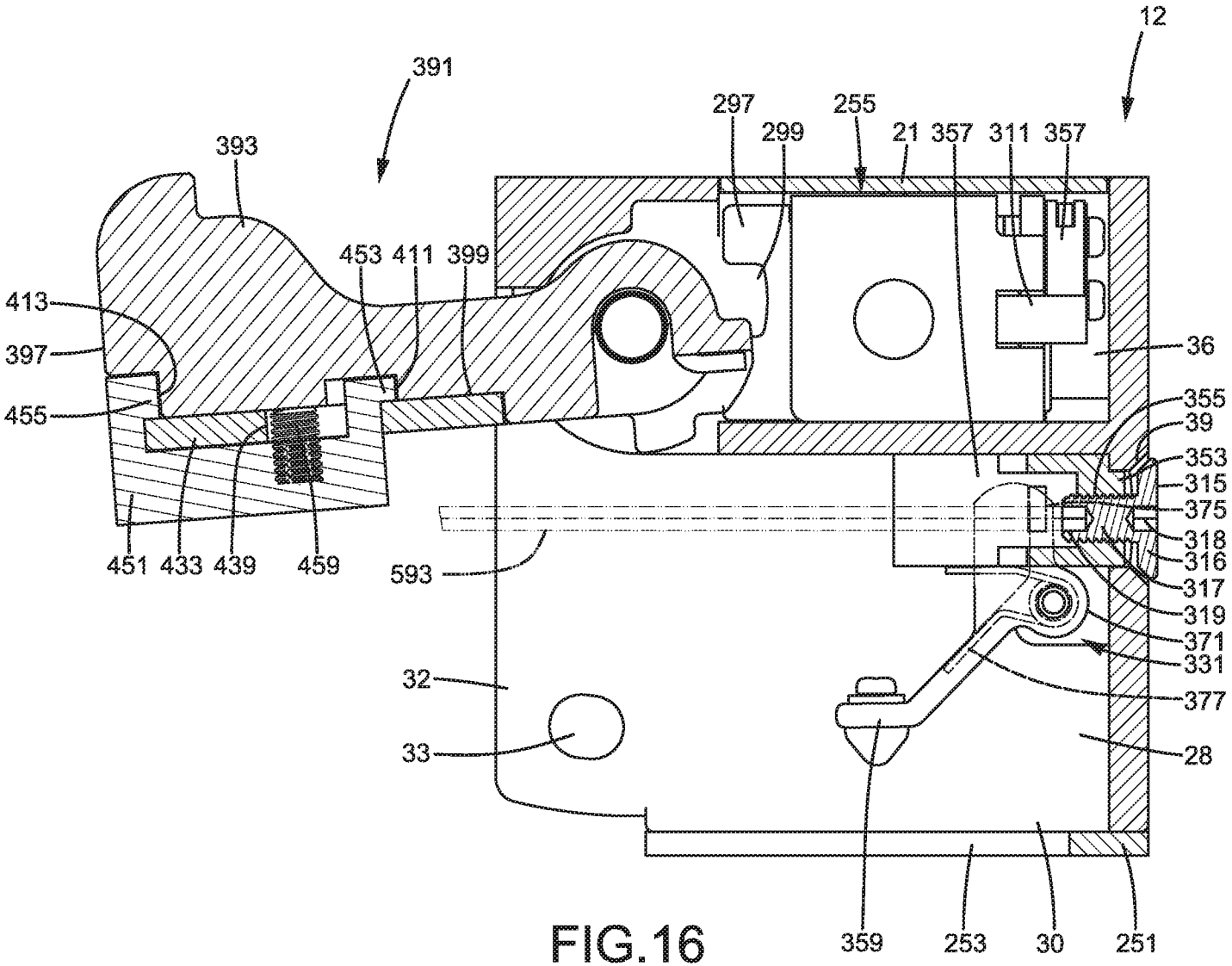
FIG. 16 is a cross sectional view illustrating the locking cap device moved to a non-closure position while using a hand tool to rotate a fixing screw.
Figure 17:
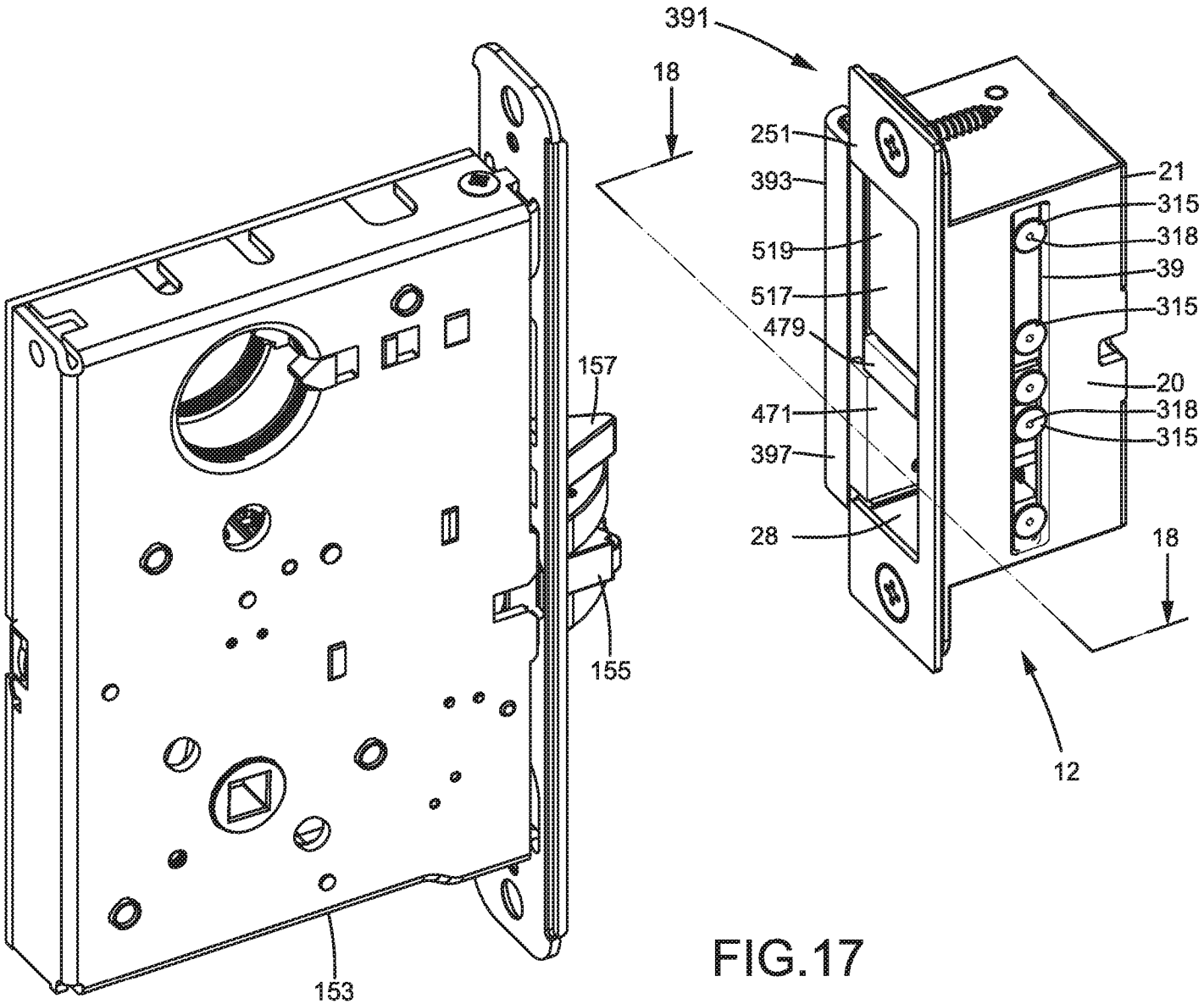
FIG. 17 is a perspective view of the latch control device assembled into a second mode.

The pivotal hole 417 of the locking cap 393 is aligned with the pivot hole 46 of the mounting seat 20. The inner surface 399 faces the first compartment 28. A pivot 137 extends through the pivot hole 46 and the pivotal hole 417 (FIG. 8). Thus, the locking cap 393 is pivotable relative to the mounting seat 20 between a closure position (FIGS. 6 and 7) and a non-closure position (FIG. 11). When the locking cap 393 is in the closure position, the locking cap 393 closes the second opening 32, the outer side 397 of the locking cap 393 is in the second opening 32, and the two receiving holes 415 of the locking cap 393 are aligned with the two pin holes 33 of the mounting seat 20. On the other hand, when the locking cap 393 is in the non-closure position, the locking cap 393 reveals the second opening 32 (FIGS. 11 and 16). A return spring 137A is mounted around the pivot 137 and is located between the locking cap 393 and the mounting seat 20. The return spring 137A biases the locking cap 393 toward the closure position.

Figure 5:
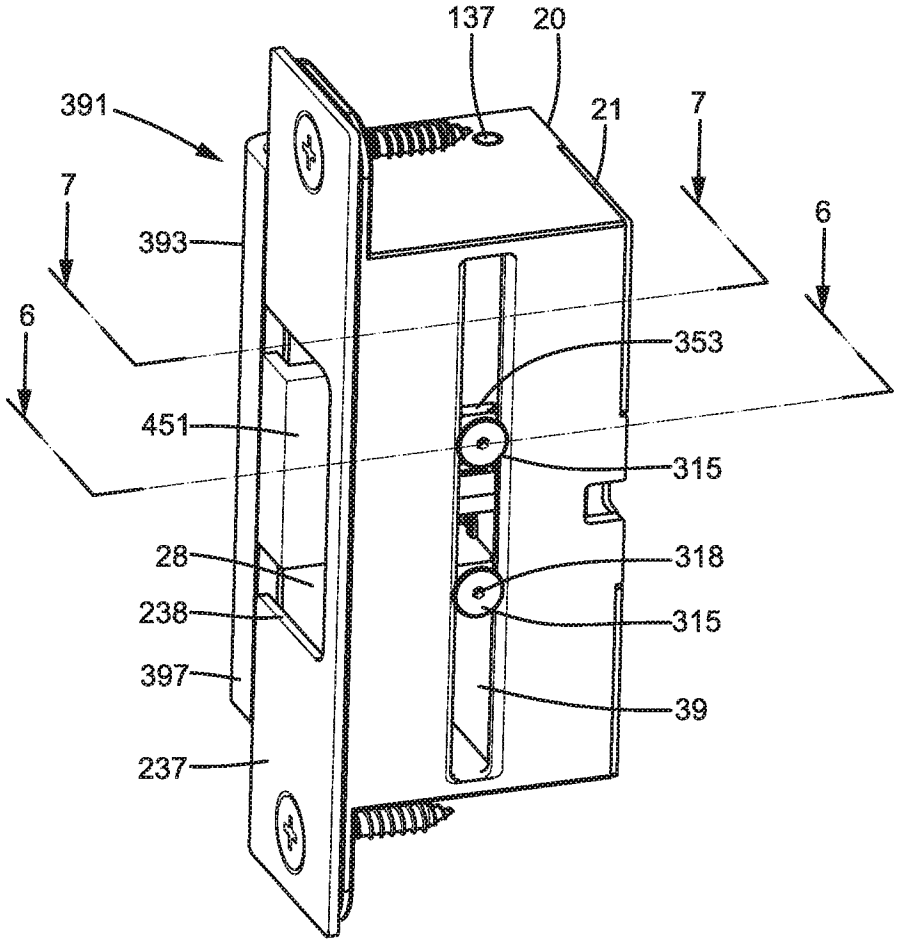
FIG. 5 is an exploded, perspective view of the latch control device assembled into a first mode and a cylindrical latch device.
Figure 5:
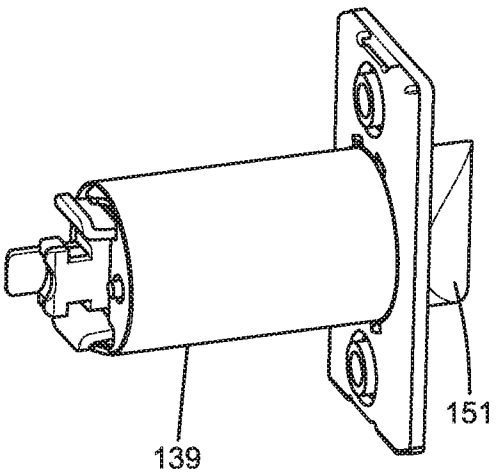

The locking cap device 391 further includes a guiding plate 433 detachably mounted to the locking cap 393. The guiding plate 433 includes a first face 435 and a second face 437 opposite to the first face 435. The guiding plate 433 further includes a guiding groove 439 extending from the first face 435 through the second face 437. Plural first screws 116 are used to detachably screw the guiding plate 433 to the inner face 399 of the locking cap 393. With reference to FIGS. 2 and 5, the guiding plate 433 covers the first groove 411. A portion of the guiding groove 439 is aligned with the first groove 411 to forma stepped portion. The guiding plate 433 covers aside of the second groove 413 to form another stepped portion.

The locking cap device 391 further includes a first lining member 451 and a second lining member 471 thinner than the first lining member 451. One of the first lining member 451 and the second lining member 471 is detachably mounted to a selective position on the guiding plate 433. The first lining member 451 includes a first coupling portion 453, a second coupling portion 455 spaced from the first coupling portion 453, and two first screw holes 457 between the first coupling portion 453 and the second coupling portion 455. The second lining member 471 includes a first engaging block 473, a second engaging block 475 spaced from the first engaging block 473, and two screw holes 477 between the first engaging block 473 and the second engaging block 475.

With reference to FIGS. 2 and 8, the locking cap device 391 further includes two high temperature locking devices 551. Each of the two high temperature locking devices 551 includes a higher melting point member 553 having an outer threading on an outer periphery thereof. Each higher melting point member 553 further includes an inner end 557 and an outer end 555. Each higher melting point member 553 further includes a smaller diameter hole section 571 extending from the outer end 555 towards but spaced from the inner end 557 and having hexagonal cross sections. Each higher melting point member 553 further includes a larger hole section 559 extending from the inner end 557 to the smaller hole section 571. Each higher melting point member 553 is made of a metal material having a higher melting point and is threadedly engaged in an associated one of the two receiving holes 415 of the locking cap 393.

Each of the two high temperature locking devices 551 further includes a lower melting point member 573 with a melting point lower than the melting point of the higher melting point member 553 and a pin 575. Each lower melting point member 573 is cylindrical and has an outer diameter smaller than the diameter of the larger hole section 559 and larger than the diameter of the smaller hole section 571. Each lower melting point member 573 can be made of plastic material. Each pin 575 includes an enlarged end 577 having an outer diameter smaller than the diameter of the larger diameter hole section 559 and larger than the diameter of the smaller hole section 571. Each pin 575 further includes a coupling end 579 extending from an end face of the enlarged end 577. Each coupling end 579 has an outer diameter slightly smaller than the diameter of the smaller hole section 571 and is received in the smaller hole section 571.

Figure 15:
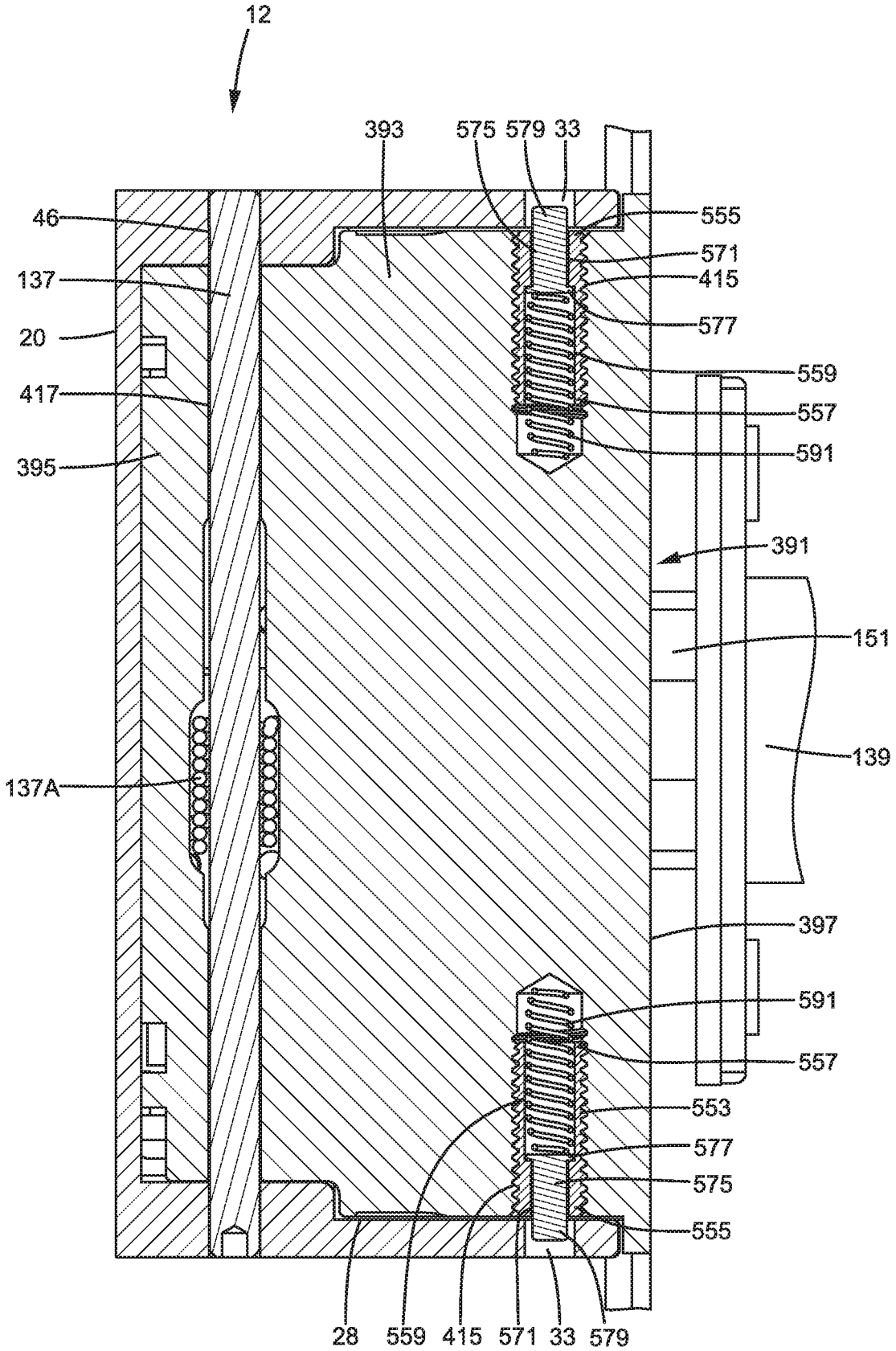
FIG. 15 is a cross sectional view illustrating the locking cap device in a closure position while two pins engaged with two pin holes of two high temperature locking device.

Each lower melting point member 573 and an associated pin 575 are received in the larger hole section 559 of an associated higher melting point member 553, with the lower melting point member 573 located between the smaller hole section 571 and the enlarged end 577 of the associated pin 575. The enlarged end 577 of each pin 575 is pressed by an ejection spring 591. Each ejection spring 591 presses an associated pin 575 towards the smaller hole section 571 of an associated higher melting point member 553. Before each lower melting point member 573 melts, the coupling end 579 of each pin 575 is located in the smaller hole section 571 of the associated higher melting point member 553 (see FIG. 8). After each lower melting point member 573 melts, each ejection spring 591 pushes the associated pin 575 to move along the larger hole section 559 until the coupling end 579 of the associated pin 575 is outside of the smaller hole section 571 (see FIG. 15).

The locking cap device 391 can be selectively coupled with the first lining member 451 or the second lining member 471. In a case that the first lining member 451 is selected (see FIG. 6), the first coupling portion 453 extends through the guiding groove 439 to engage with the first groove 411. The second coupling portion 455 extends into the second groove 413, and two tightening screws 459 engage with the two first screws holes 457. After the two tightening screws 459 are tightened and press against the inner surface 399 of the locking cap 393, the first lining member 451 is fixed and, thus, cannot move along the guiding groove 439 and cannot disengage from the guiding plate 433. When the two tightening screws 459 are loosened and no longer presses against the inner surface 399 of the locking cap 393, the first lining member 451 can move along the guiding groove 439 or disengage from the guiding plate 433.

In another case that the second lining member 471 is selected (see FIG. 18), the first engaging block 473 extends through the guiding groove 439 to engage with the first groove 411. The second engaging block 475 extends through the second groove 413, and two tightening screws 459 engage with the two second screws holes 477. After the two tightening screws 459 are tightened and press against the inner surface 399 of the locking cap 393, the second lining member 471 is fixed and, thus, cannot move along the guiding groove 439 and cannot disengage from the guiding plate 433. When the two tightening screws 459 are loosened and no longer presses against the inner surface 399 of the locking cap 393, the second lining member 471 can move along the guiding groove 439 or disengage from the guiding plate 433.

With reference to FIG. 1, the latch control device 12 further includes a first accessory 479, a second accessory 497, a third accessory 517, a first escutcheon 237, and a second escutcheon 251, all of which are optional and can be selected according to different needs. The first accessory 479 is in the form of a narrow frame having substantially rectangular cross sections. The first accessory 479 includes a first side having a first sliding block 491 with a first threaded hole 493. The first accessory 479 further includes a first through-hole 495 defined in a second side thereof opposite to the first side having the first sliding block 491, with the first through hole 495 aligned with the first threaded hole 493. The second accessory 497 includes an end wall 498, an installation wall 500 opposite to the end wall 498, and a locking latch hole 499 between the end wall 498 and the installation wall 500. A second sliding block 511 is disposed on the installation wall 500 and includes two second threaded holes 513. The end wall 498 includes two through-holes 515 respectively aligned with the two second threaded holes 513. The third accessory 517 includes a sidewall 518, an assembling wall 520 opposite to the sidewall 518, and an outer wall 519 extending between the sidewall 518 and the assembling wall 520. The sidewall 518 includes two third through-holes 535. The assembling wall 520 includes a sliding block 531 having two third threaded holes 533 aligned with the two third through-holes 535.

One of the first escutcheon 237 and the second escutcheon 251 is selectively mounted to the front face 22 of the mounting seat 20. As shown in FIG. 1, the first escutcheon 237 includes a first outlet 238 smaller than the first opening 30. The first outlet 238 is open in an edge of the first escutcheon 237. The second escutcheon 251 includes a second outlet 253 larger than the first outlet 238 and substantially equal to the first opening 30. The second outlet 253 is open in an edge of the second escutcheon 251.

Figure 3:
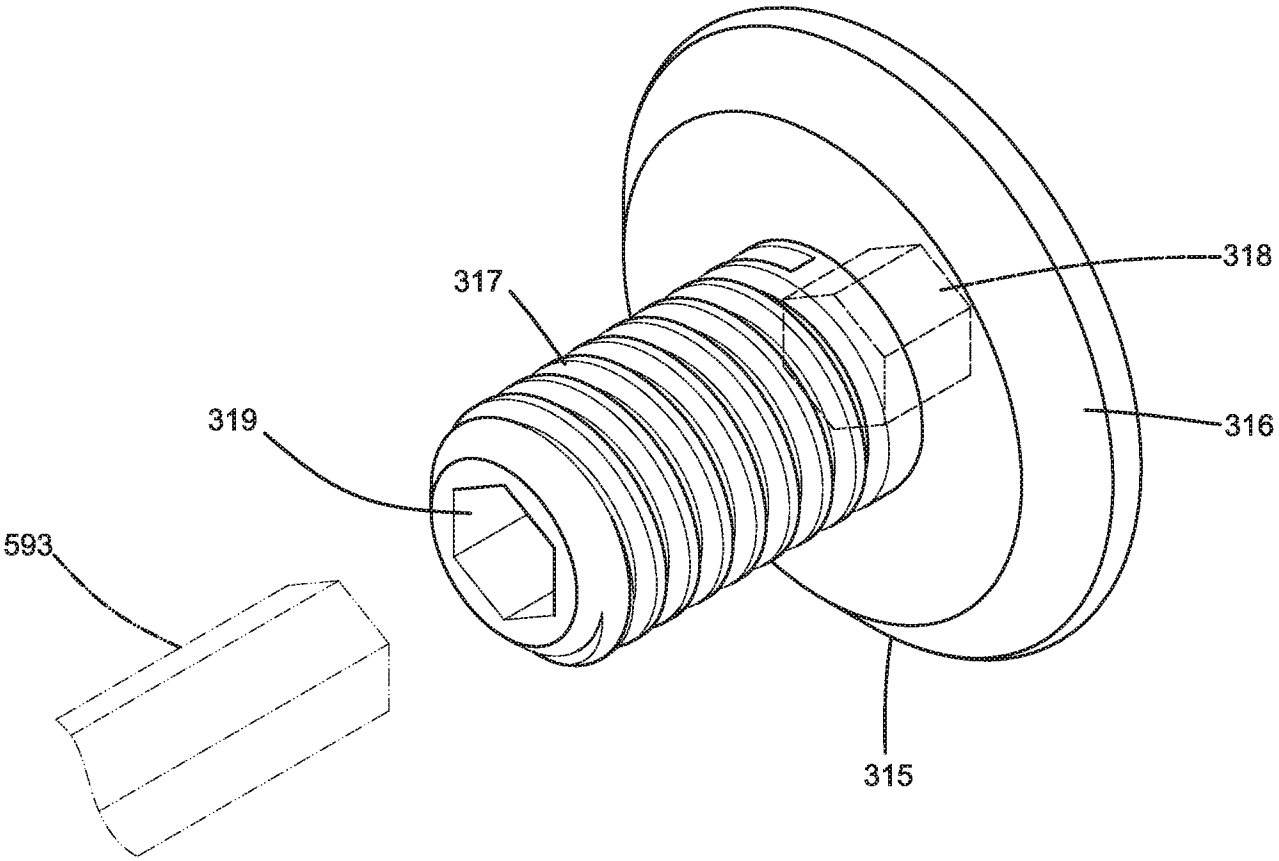
FIG. 3 is a perspective view of a fixing screw.
Figure 4:
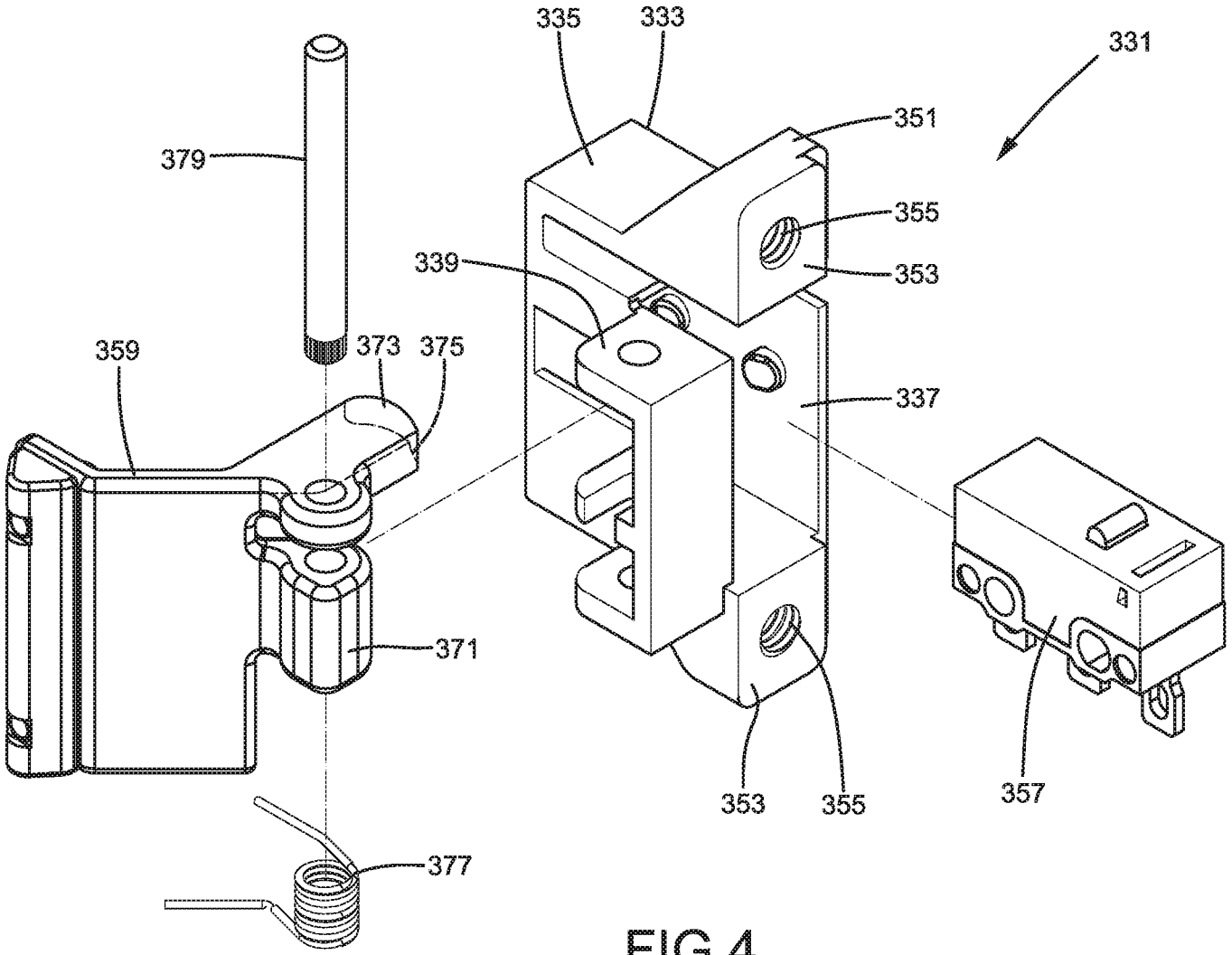
FIG. 4 is an exploded, perspective view of a detecting device of the latch control device of FIG. 1.

With reference to FIG. 3, the latch control device 12 further includes a detecting device 331 received in the first compartment 28. The detecting device 331 includes a supporting seat 333. The supporting seat 333 includes a body 335 and two engaging portions 351 on two outer sides of the body 335. Each of the two engaging portions 351 includes an end face having a sliding portion 353 with a screw hole 355. The supporting seat 333 further includes a recess 337 between the two engaging portions 351 and a pivotal portion 339 outside of the recess 337.

The detecting device 331 further includes an actuation plate 359 and a closure detection sensor 357. The actuation plate 359 includes a pivotal end 371 having a lug 373 on a side thereof. The lug 373 includes a protrusion 375 and is pivotably coupled with the pivotal portion 339 of the supporting seat 333. An axle 379 extends through the pivotal portion 339 of the supporting seat 333, such that the actuating plate 359 is pivotable relative to the supporting seat 333 to a non-contact position (FIG. 6) or a contact position (FIG. 11). A bias spring 377 is mounted around the axle 379 and is located between the actuation plate 359 and the supporting seat 333. The bias spring 377 biases the actuating plate 359 to the non-contact position.

Figure 6:
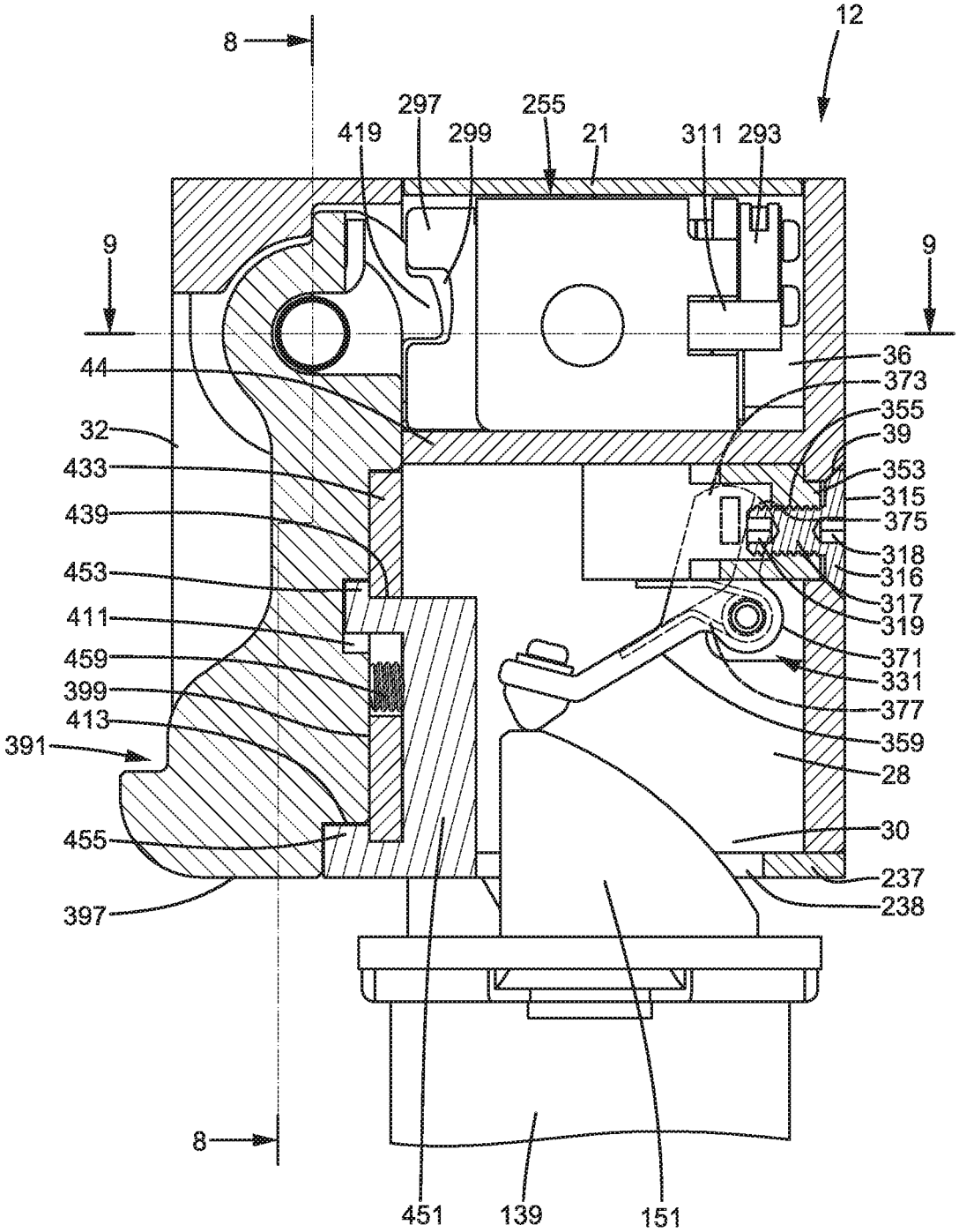
FIG. 6 is a cross sectional view taken along section line 6-6 of FIG. 5 after assembly.

The closure detection sensor 357 is comprised of a micro switch and is fixed in the recess 337. With reference to FIG. 6, when the actuation plate 359 is in the non-contact position, the protrusion 375 is spaced from and, thus, does not press against a button of the closure detection sensor 357. With reference to FIG. 11, when the actuation plate 359 is in the contact position, the lug 373 of the actuation plate 359 presses against the button of the closure detection sensor 357.

The detecting device 331 is received in the first compartment 28. The two sliding blocks 353 of the supporting seat 333 of the detecting device 331 are aligned with the track 39 of the mounting seat 20 (FIG. 6). The detecting device 331 is movable along the track 39 to a desired position. Then, two of a plurality of fixing screws 315 extends through the track 39 to engage with the screw holes 355 of the supporting seat 333. Thus, the detecting device 331 is fixed to the selected position according to the type of latch device cooperating with the latch control device 12.

With reference to FIG. 3, each of the plurality of fixing screws 315 includes a head 316 and a shank 317 extending from the head 316. The head 316 has a first driving hole 318. The shank 317 includes an end face having a second driving hole 319. The first driving hole 318 and the second driving hole 319 have hexagonal cross sections. Furthermore, the track 39 of the mounting seat 20 is slightly smaller than the head 316 of each of the plurality of fixing screws 315, such that the head 316 can be received in an enlarged section of the track 39 but cannot passes through the track 39 (see FIG. 6). After using a hexagonal wrench to engage with the first driving holes 318 of two of the plurality of fixing screws 315 (which are threadedly engaged with the two screw holes 355 of the supporting seat 333) to thereby tighten these two fixing screws 315, the supporting seat 333 of the detecting device 331 cannot move along the track 39. When these two fixing screws 315 (which are threadedly engaged with the two screw holes 355 of the supporting seat 333) are loosened by using the hexagonal wrench (see FIG. 16), the position of the detecting device 331 can be adjusted by moving along the track 39.

The latch control device 12 further includes an electric locking device 255 received in the second compartment 36. The electric locking device 255 includes a bracket 257 having a longitudinal wall 259 and two end walls 271 on two opposite ends of the longitudinal wall 259. Each of the two opposite ends of the longitudinal wall 259 includes a through-hole 273. The bracket 257 further includes an engaging wall 275 extending from a side of the longitudinal wall 259 and located between the two end walls 271. The engaging wall 275 includes an engaging slot 277 having a first end 279 and a second end 291 spaced from the first end 279.

Figure 9:
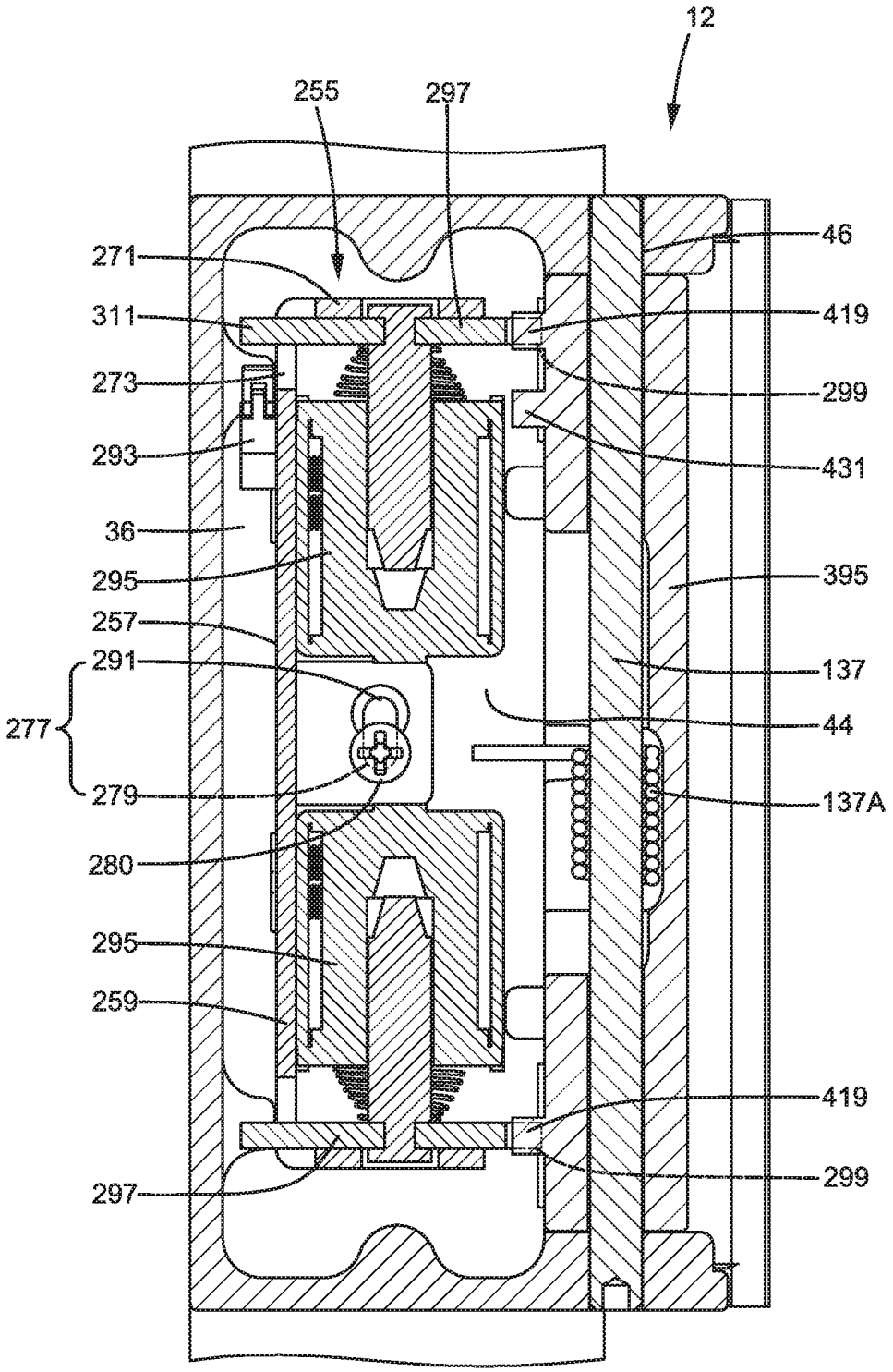
FIG. 9 is a cross sectional view taken along section line 9-9 of FIG. 6.
Figure 10:
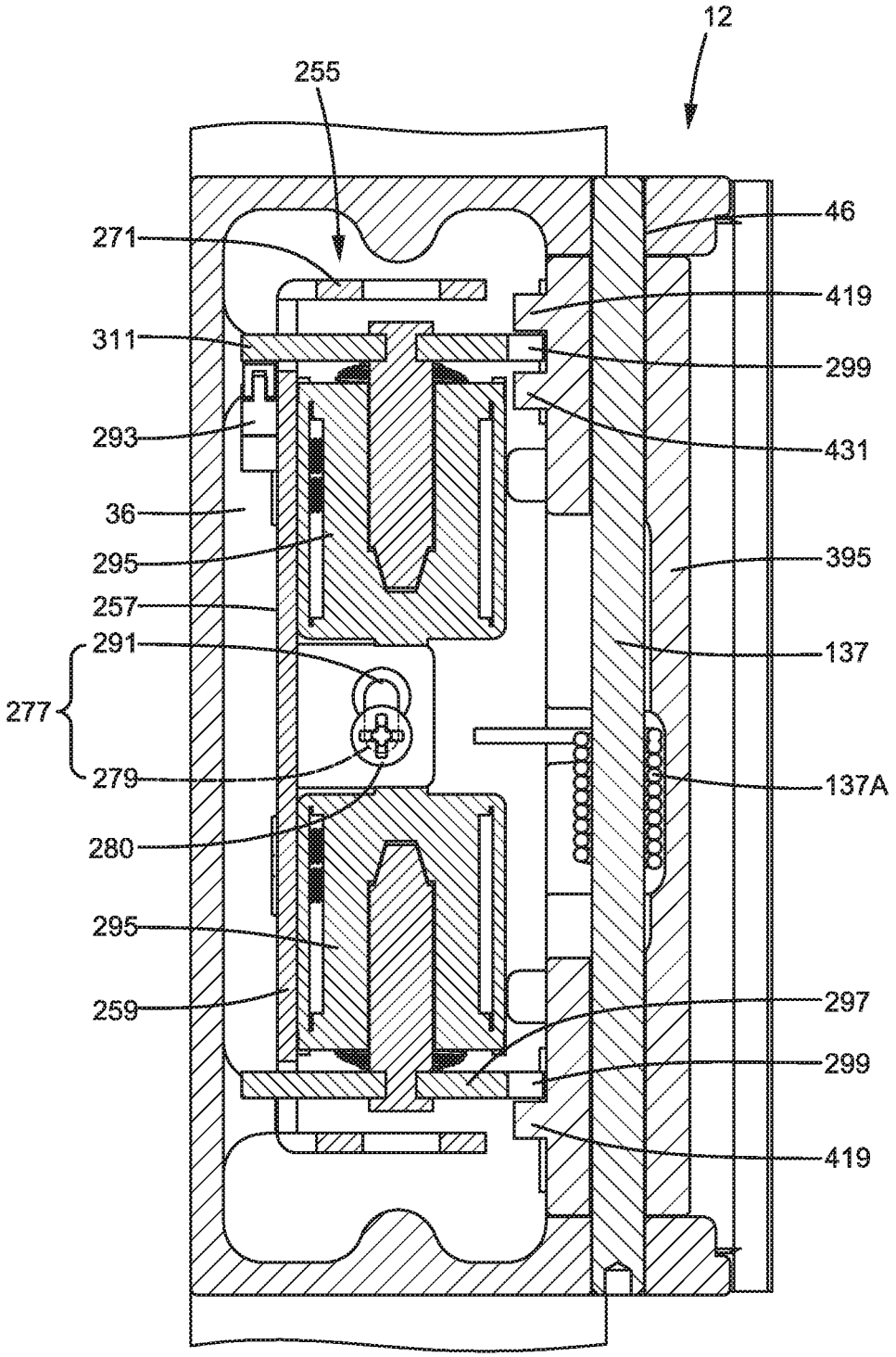
FIG. 10 is a view similar to FIG. 9 with a locking member of an electric locking device moved to a retracted position.

The latch control device 12 further includes two driving members 295 mounted on the bracket 257 and two locking members 297 respectively driven by the two driving members 295. The two driving members 295 can be electromagnetic valves. Each of the two locking members 297 includes an insertion groove 299 and an activation end 311 spaced from the insertion groove 299. Each locking member 297 is coupled to one of the two driving members 295. Thus, each of the two driving members 295 can drive a respective locking member 297 between a retracted position (FIG. 10) and an extended position (FIG. 9). The two driving members 295 are fixed to the longitudinal wall 259 and are respectively adjacent to the two end walls 271. The activation end 311 of each of the two driving members 297 extends through a respective through-hole 273. A status sensor 293 is disposed on the longitudinal wall 259 and is located adjacent to the activation end 311 of one of the two driving members 297.

Figure 13:
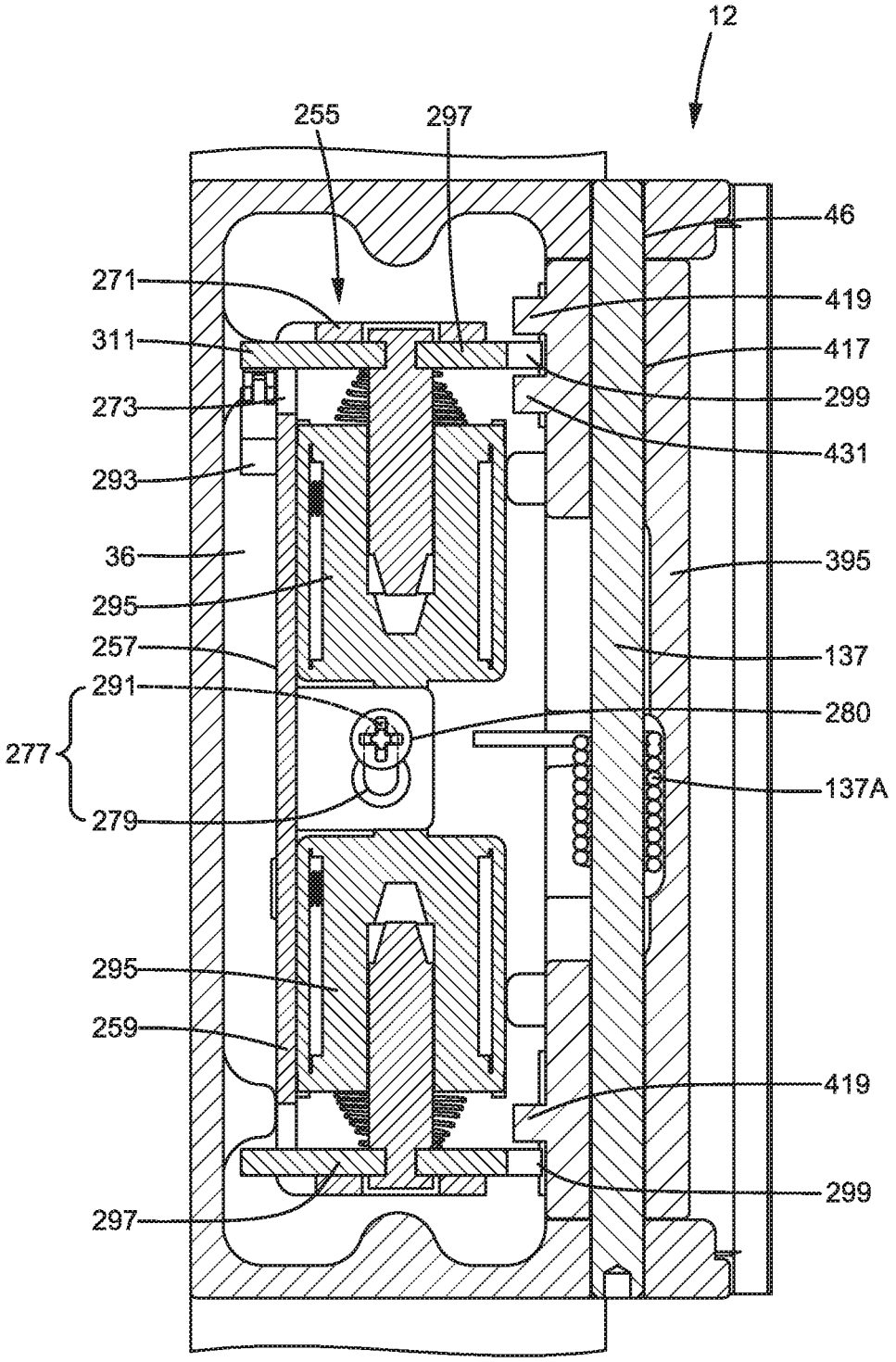
FIG. 13 is a cross sectional view of the latch control device installed in a second position and with the locking member in an extended position.

Through use of the bracket 257 and the engaging portion 44 of the mounting seat 20, the electric locking device 255 is selectively mounted by a screw 280 to a first position (FIG. 9) on the first end 279 of the engaging slot 277 aligned with the engaging portion 44 or a second position (FIG. 13) on the second end 291 of the engaging slot 277 aligned with the engaging portion 44. When the electric locking device 255 is mounted to the first position, each of the two locking members 297 is aligned with a respective first coupling portion 419 of the locking cap device 391 (FIG. 9). When the electric locking device 255 is mounted to the second position, each of the two locking members 297 is misaligned from the respective first coupling portion 419 of the locking cap device 391 (FIG. 13). Furthermore, one of the two locking members 297 is located between the first and second coupling portions 419 and 431. Furthermore, a lid 21 is mounted to the rear face 23 of the mounting seat 20 to close the second compartment 36.

Through adjustment and locations of the components in the first compartment 28, the latch control device 12 can be assembled into one of a plurality of different modes for cooperating with different types of latch devices. With reference to FIGS. 5-9, in a case that the latch control device 12 is assembled into a first mode, the electric locking device 255 is installed in a first position that is normally closed (FIG. 9).

Since the cylindrical latch device 139 includes only one latch 151, the first accessory 479, the second accessory 497, and the third accessory 517 are not mounted in the first compartment 28. Thus, the first compartment 28 only receives the detecting device 331. Furthermore, the first escutcheon 237 is mounted to cooperate with the cylindrical latch device 139 (see FIG. 5), and the first outlet 238 of the first escutcheon 237 is substantially located in a center of the first opening 30. Furthermore, the first opening 30 is partially covered by the first escutcheon 237. Since the size of the first outlet 238 is slightly larger than the latch 151 of the cylindrical latch device 139, the latch 151 is permitted to pass through the first outlet 238 into the first compartment 28. Furthermore, since the latch 151 is located in the center of the first compartment 28, after loosening two of the plurality of fixing screws 315, the detecting device 331 can be adjusted to a position substantially in the center of the first compartment 28 and aligns with the first outlet 238 of the first escutcheon 237 (FIG. 6), and these two fixing screws 315 are retightened to fix the detecting device 331.

When the first accessory 479 or the second accessory 497 is not in a correct position and when the locking cap device 391 is in the non-closure position, a hand tool 593 can pass through the first through-hole 495 of the first accessory 479 to engage with the second driving hole 319 of an associated fixing screw 315, or can pass through each second through-hole 515 of the second accessory 497 to engage with the second driving hole 319 of each associated fixing screw 315. Thus, the hand tool 593 can loosen each associated fixing screw 315 and can adjust the position of the first accessory 479 and/or the second accessory 497. When the correct position is reached, each associated fixing screw 315 can be tightened to fix the first accessory 479 and/or the second accessory 497.

Furthermore, when the first lining member 451 corresponding to the size of the latch 151 of the cylindrical latch device 139 is selected and is mounted to the guiding plate 433, before the two tightening screws 459 are tightened, the first lining member 451 can be moved to a position aligned with the detecting device 331. Then, the two tightening screws 459 are tightened to press against the inner surface 399 of the locking cap 393, and the first lining member 451 is fixed in the position aligned with the detecting device 331.

Figure 7:
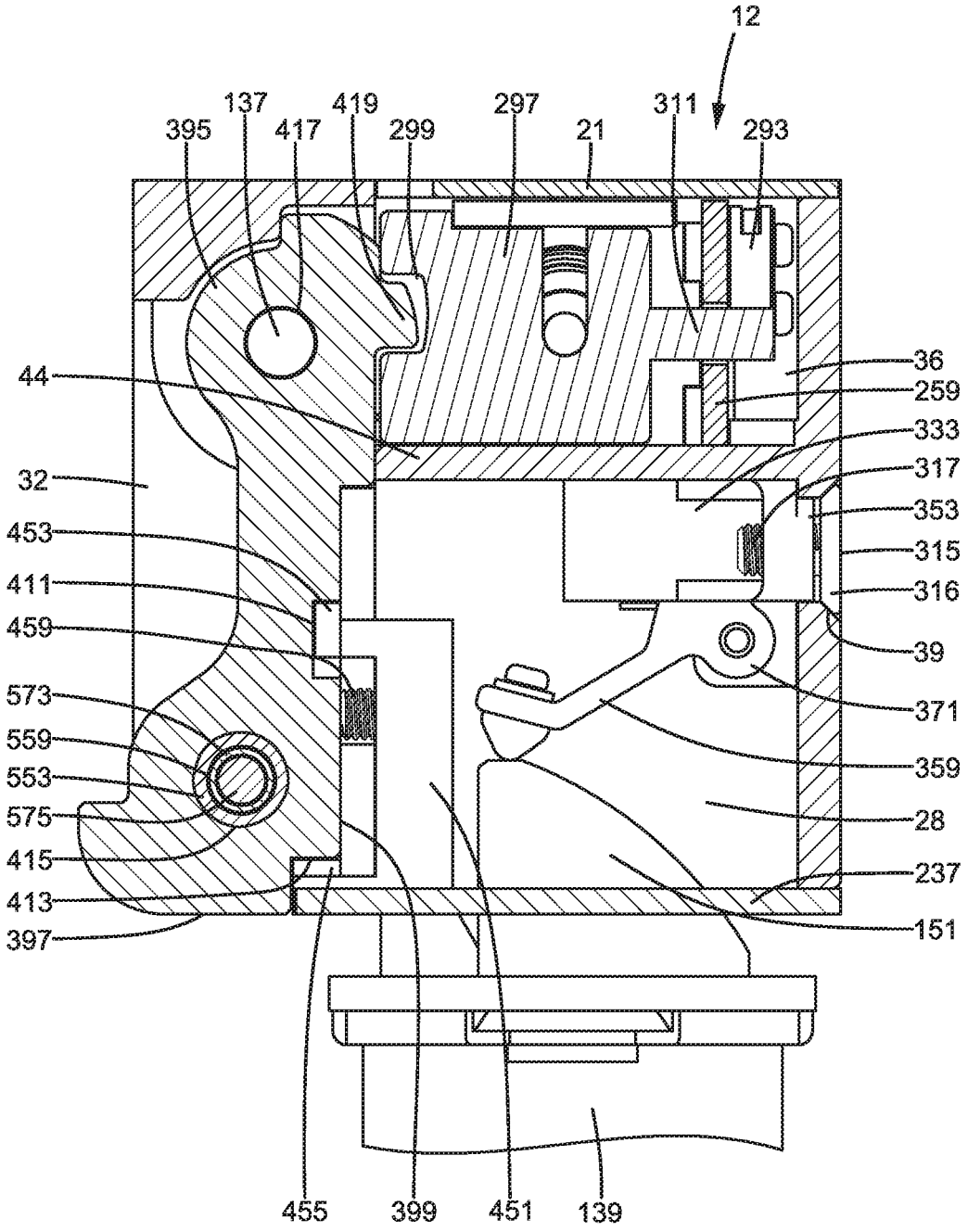
FIG. 7 is a cross sectional view taken along section line 7-7 of FIG. 5.
Figure 8:
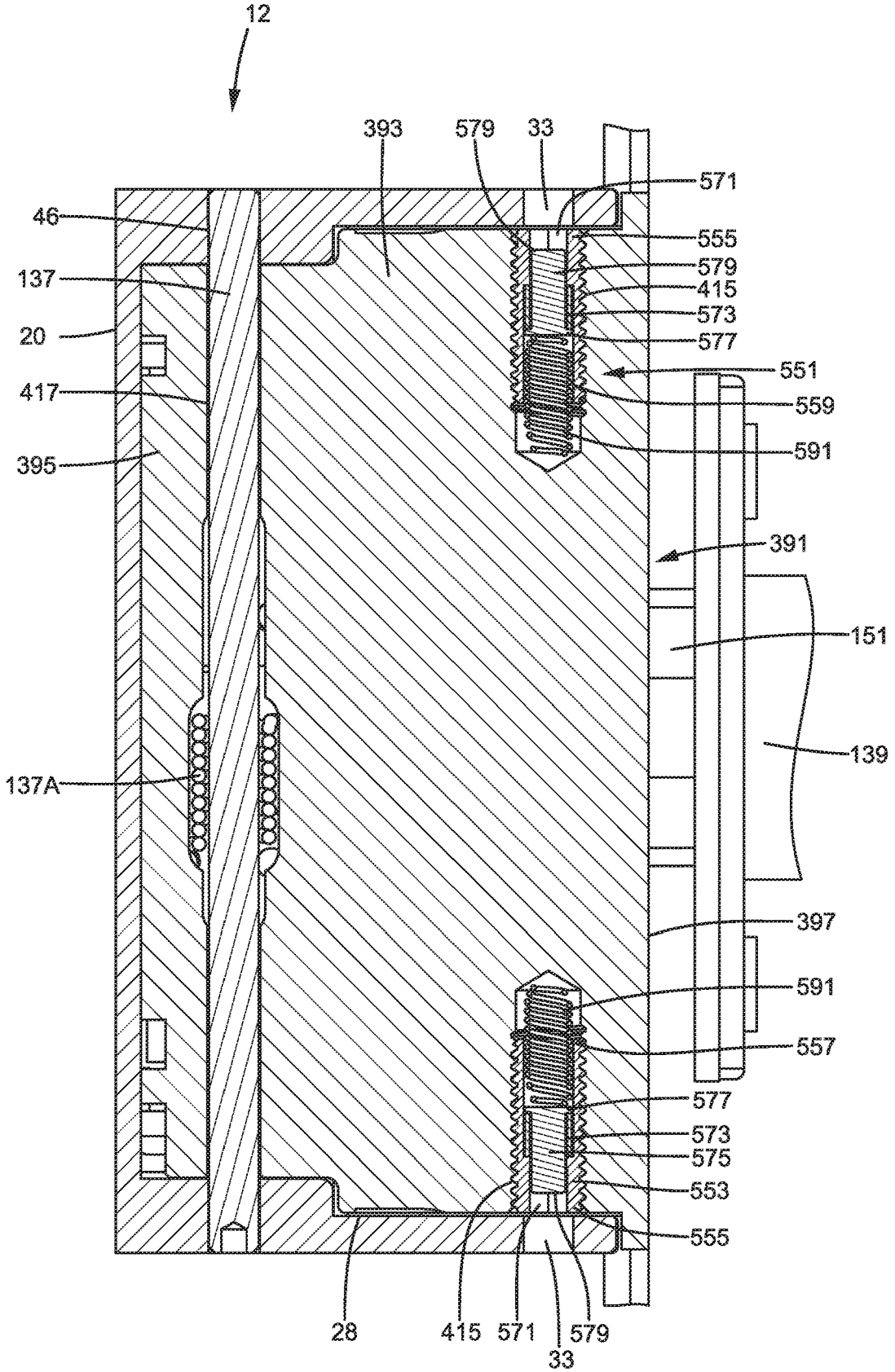
FIG. 8 is a cross sectional view taken along section line 8-8 of FIG. 6.

With reference to FIGS. 6 and 7, when the door is closed, the latch 151 of the cylindrical latch device 139 is received in the first compartment 28 of the mounting seat 20. The actuation plate 359 is pressed by the latch 151 to the non-contact position. The protrusion 375 of the actuation plate 359 is spaced from the button of the closure detection sensor 357. Thus, the door is detected to be in the closed position.

Assuming that the latch 151 of the cylindrical latch device 139 is in the first compartment 28 and the locking cap device 391 is in the closure position, when the two locking members 297 of the electric locking device 255 are in the extended position (FIG. 9), the insertion groove 299 of each of the two locking members 297 is engaged with a respective first coupling groove 419 (FIGS. 7 and 9), such that the locking cap device 391 is locked by the electric locking device 255 and, thus, cannot move from the closure position to the non-closure position. The latch 151 of the cylindrical latch device 139 is restrained by the first lining member 451 cooperating with the first outlet 238 of the first escutcheon 237. Furthermore, the latch 151 of the cylindrical latch device 139 cannot disengage from the first compartment 28. Accordingly, the door is locked and, thus, cannot be opened.

When the electric locking device 255 receives an unlocking signal, each of the two driving members 295 actuates a respective locking member 297 to move from the extended position (FIG. 9) to the retracted position (FIG. 13). In this state, the displacement of each of the two locking members 297 is not impeded by the respective first coupling portion 419. Furthermore, the activation end 311 of one of the two locking members 297 presses against the status sensor 293 nearby (FIG. 13). Thus, the latch control device 12 is detected to be set in the unlocked state. In the unlocked state, the locking cap device 391 is not locked. Thus, when the door is pushed, the latch 151 of the cylindrical latch device 139 presses against the first lining member 451 of the locking cap device 391, pivoting the locking cap device 391 from the closure position (FIG. 6) to the non-closure position (FIG. 11). Consequently, the latch 151 of the cylindrical latch device 139 can completely disengage from the latch control device 12.

Figure 12:
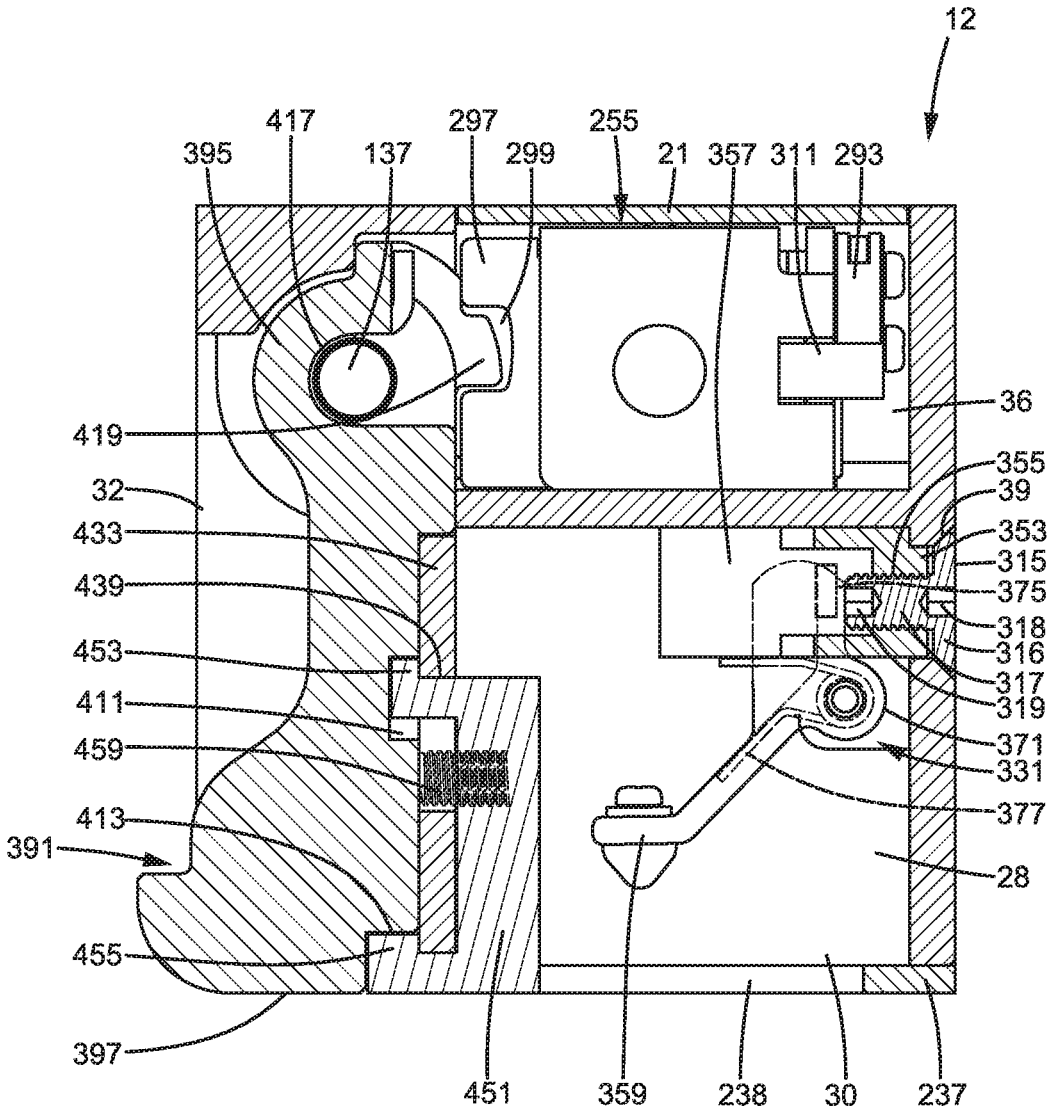
FIG. 12 is a view similar to FIG. 6 with the cylindrical latch device detached from the latch control device assembled into the first mode.

After the latch 151 completely disengages from the latch control device 12, the return spring 137A returns the locking cap 393 to the closure position, and the bias spring 377 returns the actuation plate 359 to the contact position (FIG. 12). The closure detection sensor 357 is pressed by the protrusion 375 of the actuation plate 359, such that each of the two driving members 295 moves a respective locking member 297 from the retracted position to the extended position. The two first coupling portions 419 of the locking cap device 391 reengage with the insertion grooves 299 of the two locking members 297, thereby locking the locking cap device 391.

When it is intended to close the door after the locking cap device 391 is locked while the latch 151 of the cylindrical latch device 139 is outside of the first compartment 28 of the mounting seat 20, the latch 151 of the cylindrical latch device 139 is pressed by the locking cap device 391 and retracts (not shown), such that cylindrical latch device 139 moves together with the door to a position aligned with the first outlet 238 of the first escutcheon 237. The latch 151 moves to the extended position and actuates the actuation plate 359 to pivot from the contact position to the non-contact position again. Consequently, the latch 151 of the cylindrical latch device 139 is locked in the first compartment 28 of the mounting seat 20.

Figure 14:
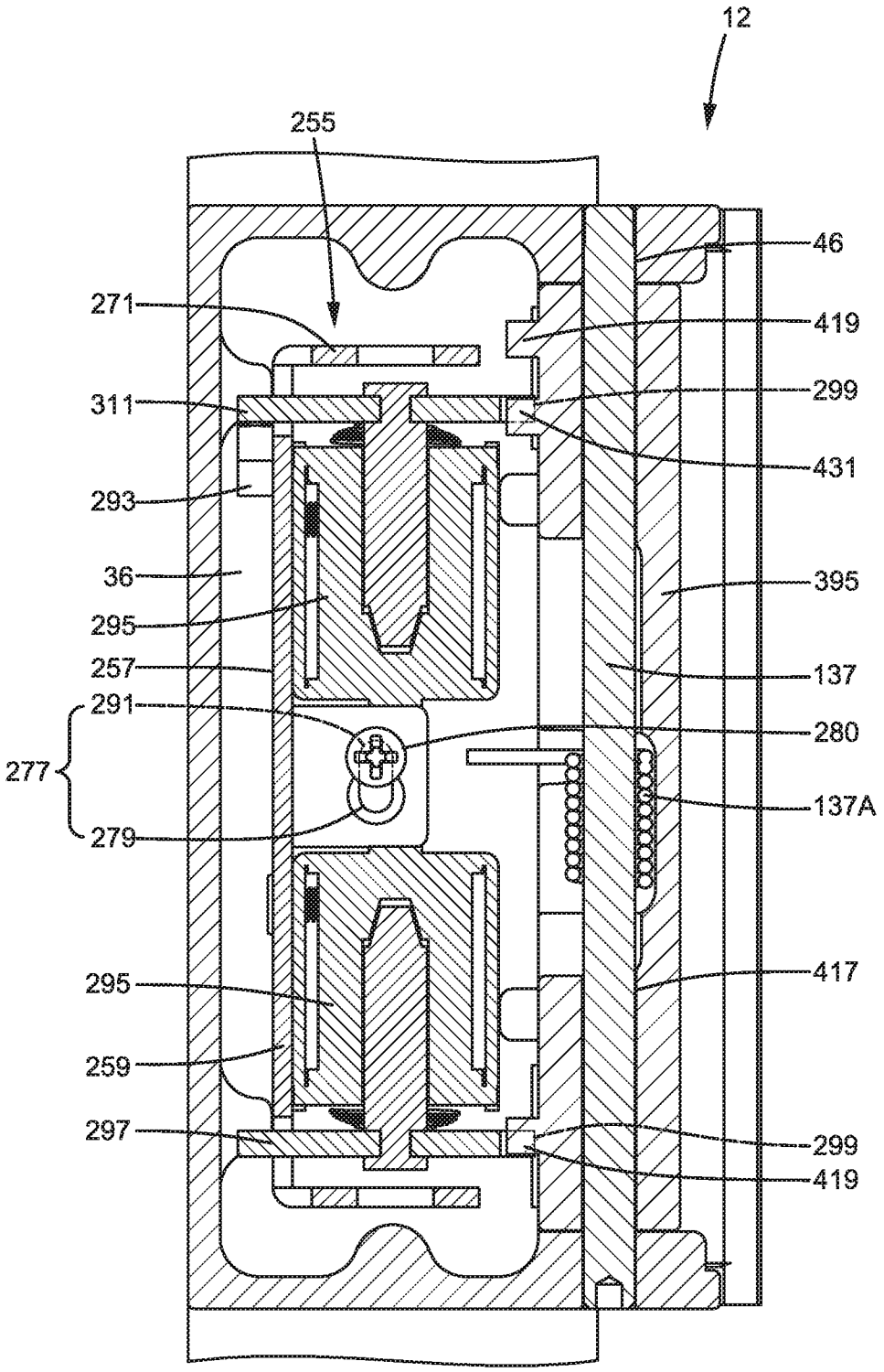
FIG. 14 is a view similar to FIG. 13 with the locking member in a retracted position.

Furthermore, in addition to setting the electric locking device 255 installed in the first position as a normally closed state, the electric locking device 255 installed in the second position can be set as a normally open state. With reference to FIG. 13, in a case that the electric locking device 255 is installed in the second position, when the locking cap device 391 is in the closure position and each of the two locking members 297 is in the extended position, one of the two locking members 297 is misaligned from the first and second coupling portions 419 and 431, and the other locking member 297 is misaligned from the two first coupling portions 419, such that the locking cap device 391 is not locked. As a result, the latch 151 of the cylindrical latch device 139 is pivotable together with the door to pivot the locking cap device 391 from the closure position to the non-closure position. With reference to FIG. 14, when each of the two driving members 295 actuates the respective locking member 297 to the retracted position and the locking cap device 391 is in the closure position, the insertion groove 299 of one of the two locking members 297 engages with the second engaging portion 431, and the other locking member 297 engages with one of the two first coupling portions 419. Thus, the locking cap device 391 is locked.

Thus, by changing the installation position of the electric locking device 255 in the first position or the second position, the latch control device 12 can be set in a normally open state or a normally closed state.

Note that when the locking cap device 391 is in the closure position, the two high temperature locking devices 551 are aligned with the two pin holes 33 of the mounting seat 20 (FIG. 8). In a case that a fire occurs and, thus, generates high heat, the lower melting point members 573 made of plastic material melt, and each ejection springs 591 pushes the associated pin 575 to engage the coupling end 579 of the associated pin 575 with an associated pin hole 33 (see FIG. 15). In this state, even though each of the two locking members 297 is moved to a position misaligned from the first and second coupling portions 419 and 431, the locking cap device 391 cannot move from the closure position to the non-closure position. Thus, the latch 151 of the cylindrical latch device 139 is retained in the first compartment 28. As a result, the door cannot be opened.

In addition to assembling the latch control device 12 into the first mode cooperating with the cylindrical latch device 139, the latch control device 12 can be assembled into a second mode for cooperating with a first box type latch device 153. With reference to FIGS. 17-20, the first box type latch device 153 is mounted inside a door and includes a first latch 155 and a first anti-pick latch 157. The first latch 155 and the first anti-pick latch 157 are exposed outside of an end face of the door.

Since the first latch 155 of the first box type latch device 153 is at a lower side of the first compartment 28, each of the two locking members 297 must be spaced from the first and second coupling portions 419 and 431. Then, the locking cap device 391 is manually pivoted from the closure position to the non-closure position. Thus, two second driving holes 319 of two fixing screws 315 attached to the detecting device 331 will be exposed, and a hand tool 593 (such as a hexagonal wrench or a screwdriver) can be used to couple with each second driving hole 319 to loosen the associated fixing screws 315. Next, the detection device 331 is moved along the track 39 to a position near the lower end of the first compartment 28 (which is substantially aligned with the first latch 155, see FIG. 19) and is then fixed by again using the hand tool 593 to fix these two fixing screws 315. Then, the two tightening screws 459 can be detached to remove the first lining member 451. Since the first latch 155 of the first box type latch device 153 is larger in size, the second lining member 471 thinner than the first lining member 451 is selected. Specifically, the first engaging block 473 of the second lining member 471 is placed into the first groove 411, and the second engaging block 475 is placed into the second groove 413. Furthermore, the second lining member 471 is moved along the guiding groove 439 to a position substantially aligned with the detecting device 331. Next, two tightening screws 459 are engaged with the two second screw holes 477 and press against the inner surface 399 of the lock cap 393, thereby securing the second lining member 471 to the guiding plate 433. Note that a spacing between an outer surface of the second lining member 471 and the first face 435 of the guiding plate 433 is smaller than a spacing between an outer surface of the first lining member 451 and the first face of the guiding plate 433. The first escutcheon 237 is detached, and the second escutcheon 251 is mounted to the front face 22 of the mounting seat 20 to match with the position of the first latch 155 of the first box type latch device 153.

Furthermore, when it is desired to assemble the latch control device 12 into the second mode, the third accessory 517 and the first accessory 479 corresponding to the first anti-pick latch 157 are installed in the first compartment 28 of the mounting seat 20. Since the first box type latch device 153 does not include a locking latch, the empty space in the first compartment 28 must be filled. In an approach, the third accessory 517 is disposed in a position near the upper end of the first compartment 28 to conform to the position of the first box type latch device 153, and the third sliding block 531 is slidably received in the guiding plate 433. To fix the third accessory 517 in the first compartment 28, two fixing screws 315 are used to couple with the two third threaded holes 533 via the track 39 from outside of the mounting seat 20. These two fixing screws 315 are tightened to tightly press the third accessory 517 against the inner surface of the first chamber 28 for positioning purposes.

Note that in a case that the first accessory 491 or the third accessory 517 is in an incorrect position, when the locking cap device 391 is in the non-closure position, the hand tool 593 is used to extend through the first through-hole 495 of the first accessory 479 or the third through-hole 535 of the third accessory 517 to couple with the second driving hole 319 of an associated fixing screw 315. By loosening (not detaching) these two fixing screws 315, the position of the first accessory 479 or the third accessory 517 can be adjusted along the track 39. After the first accessory 479 or the third accessory 517 reaches the correct position, these two fixing screws 315 are tightened to fix the position of the first accessory 479 and the third accessory 517.

Figure 19:
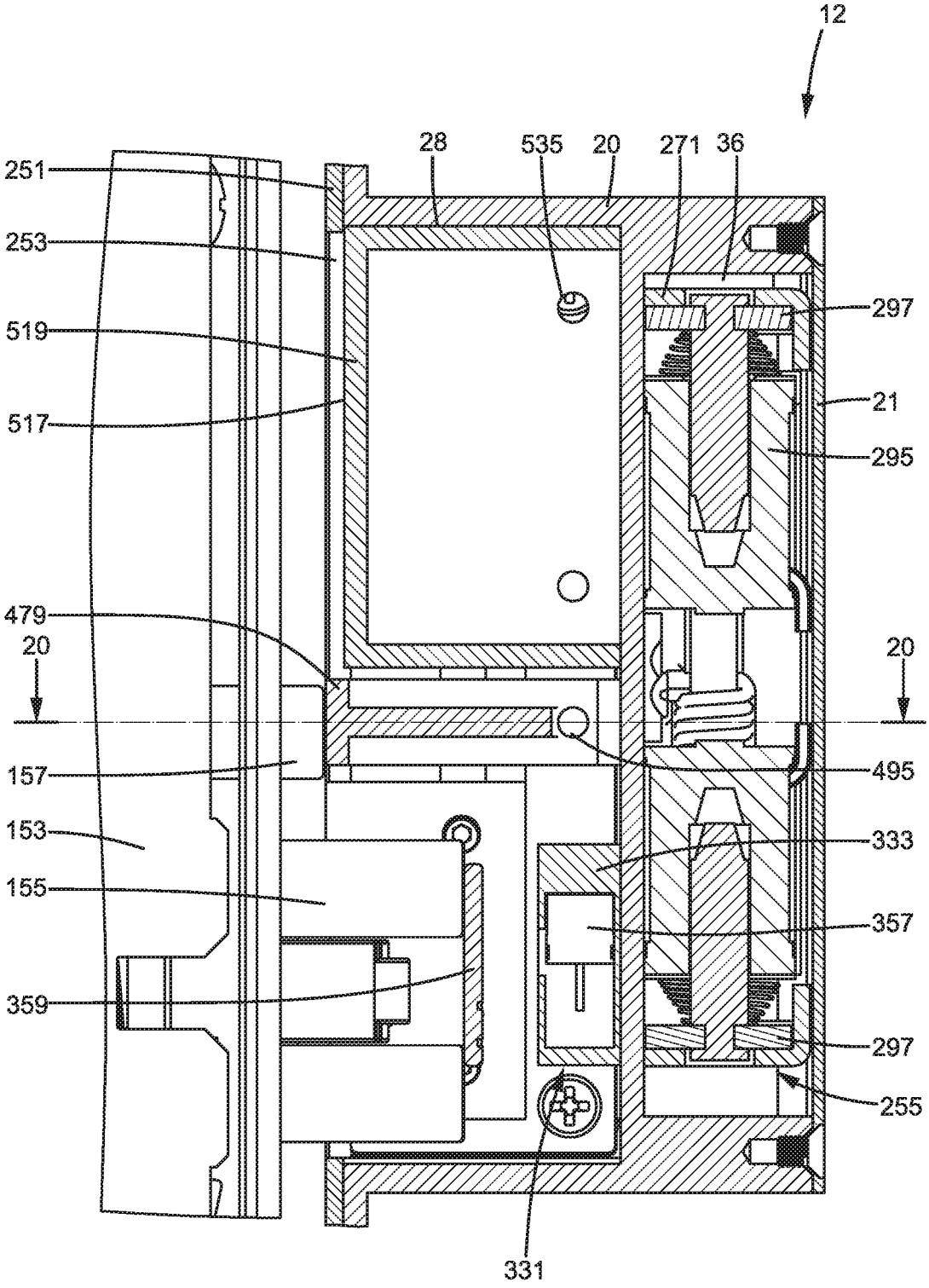
FIG. 19 is a cross sectional view taken along section line 19-19 of FIG. 18.

The first accessory 479 is received in the first compartment 28 and is aligned with the first anti-pick latch 157 of the first box type latch device 153 (i.e., between the detecting device 331 and the third accessory 517, see FIG. 19). The first sliding block 491 of the first accessory 479 is received in the track 39. One of the fixing screws 315 extends from outside of the mounting seat 20 through the track 39 to threadedly couple with the first threaded hole 493. When this fixing screw 315 is tightened, the first accessory 479 tightly presses against the inner surface of the first compartment 28 and is, thus, fixed. As a result, the first accessory 479 is fixed in a position aligned with the first anti-pick latch 157.

Figure 18:
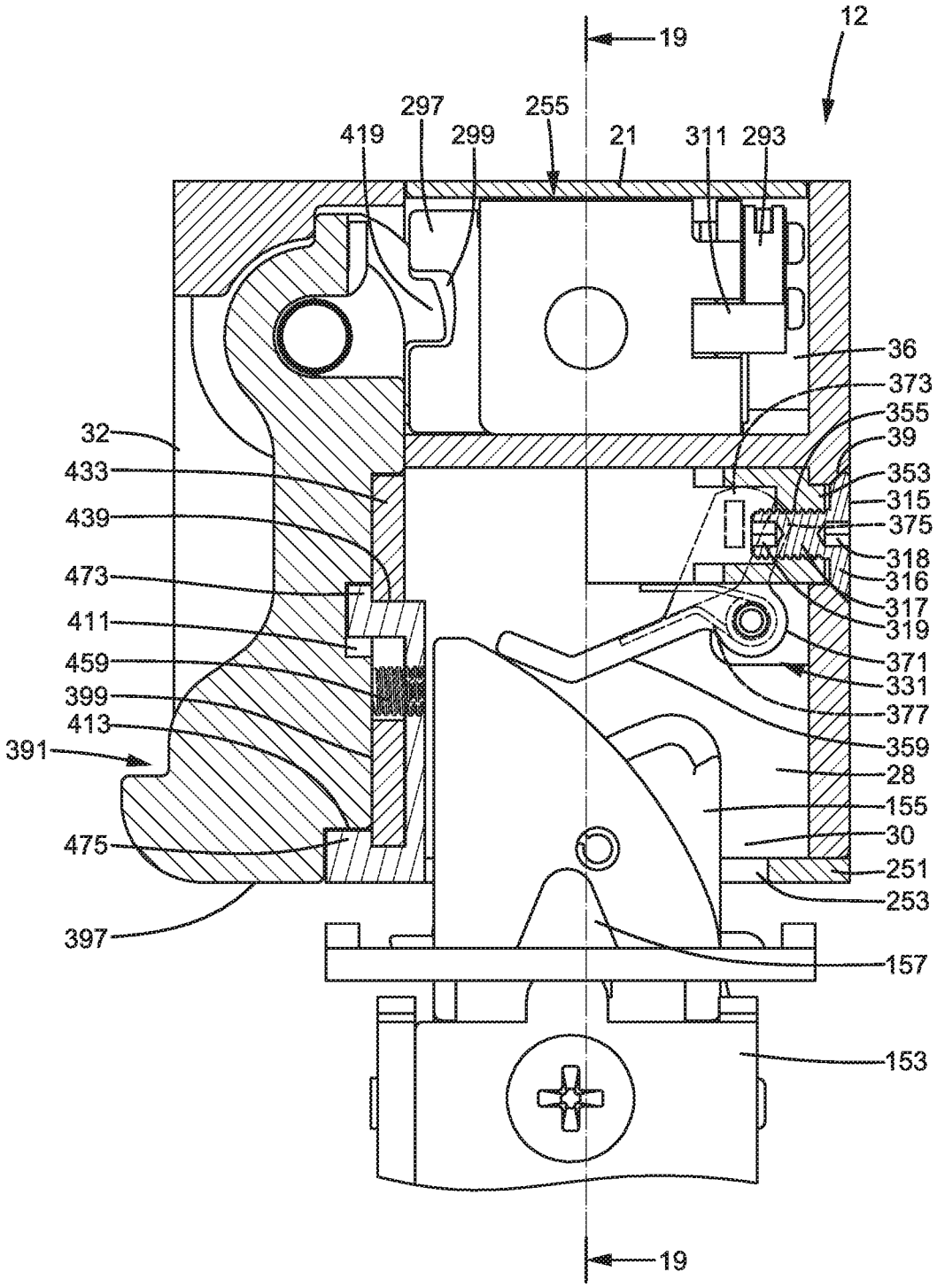
FIG. 18 is a cross sectional view taken along section line 18-18 of FIG. 17.
Figure 20:
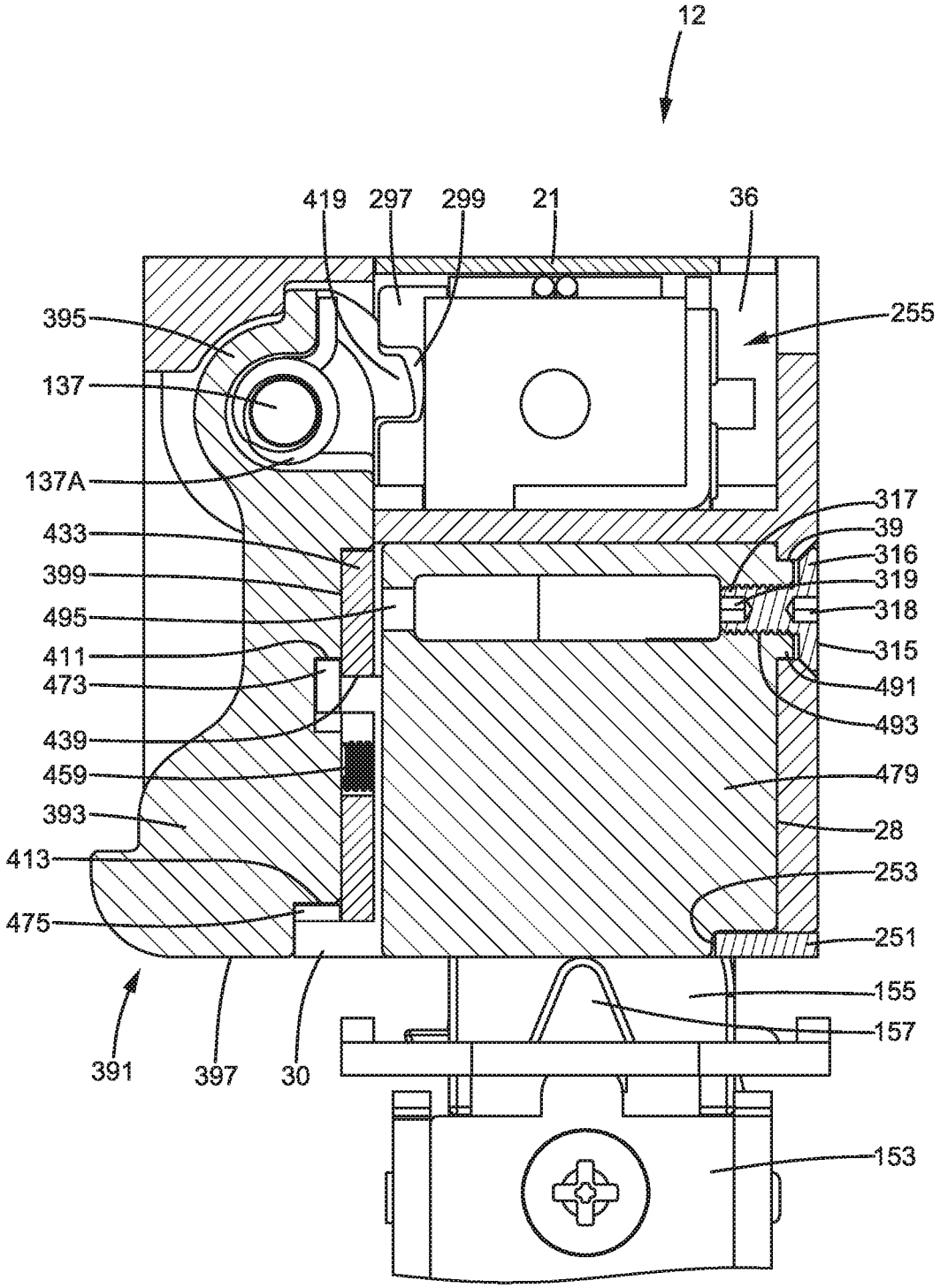
FIG. 20 is a cross sectional view taken along section line 20-20 of FIG. 19.

With reference to FIG. 18, when the first latch 155 is in the first compartment 28, the actuation plate 359 of the detecting device 331 is pressed by the first latch 155 to the non-contact position. With reference to FIGS. 19 and 20, the first anti-pick latch 157 is pressed by the first accessory 479 and retracts. With the first anti-pick latch 157 in the retracted state, the first latch 155 cannot be pressed and retracted. Thus, the first latch 155 provides an anti-pick effect. The space in the first compartment 28 not cooperating with the first box type latch device 153 is filled by the third accessory 517 (see FIG. 19).

Similarly, when the door is pushed while the locking cap device 391 is in the unlocked state, the first latch 155 of the first box type latch device 153 presses against the second lining member 133 to pivot the locking cap device 391 from the closure position to the non-closure position. On the other hand, when the locking cap device 391 is in the locked state, the first latch 155 of the first box type latch device 153 is restrained in the first compartment 28 of the mounting seat 20.

Figure 21:
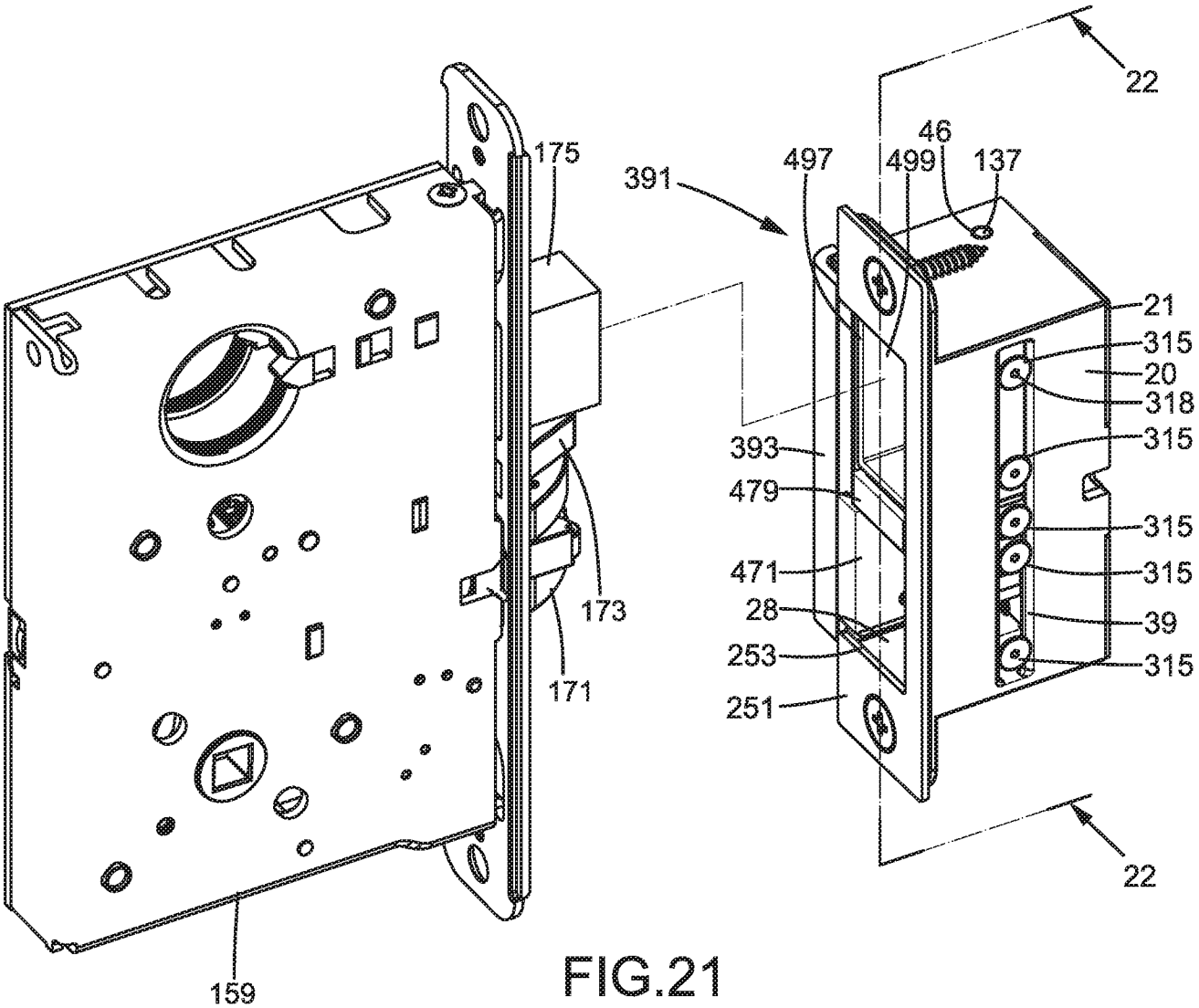
FIG. 21 is a perspective view of the latch control device assembled into a third mode.
Figure 22:
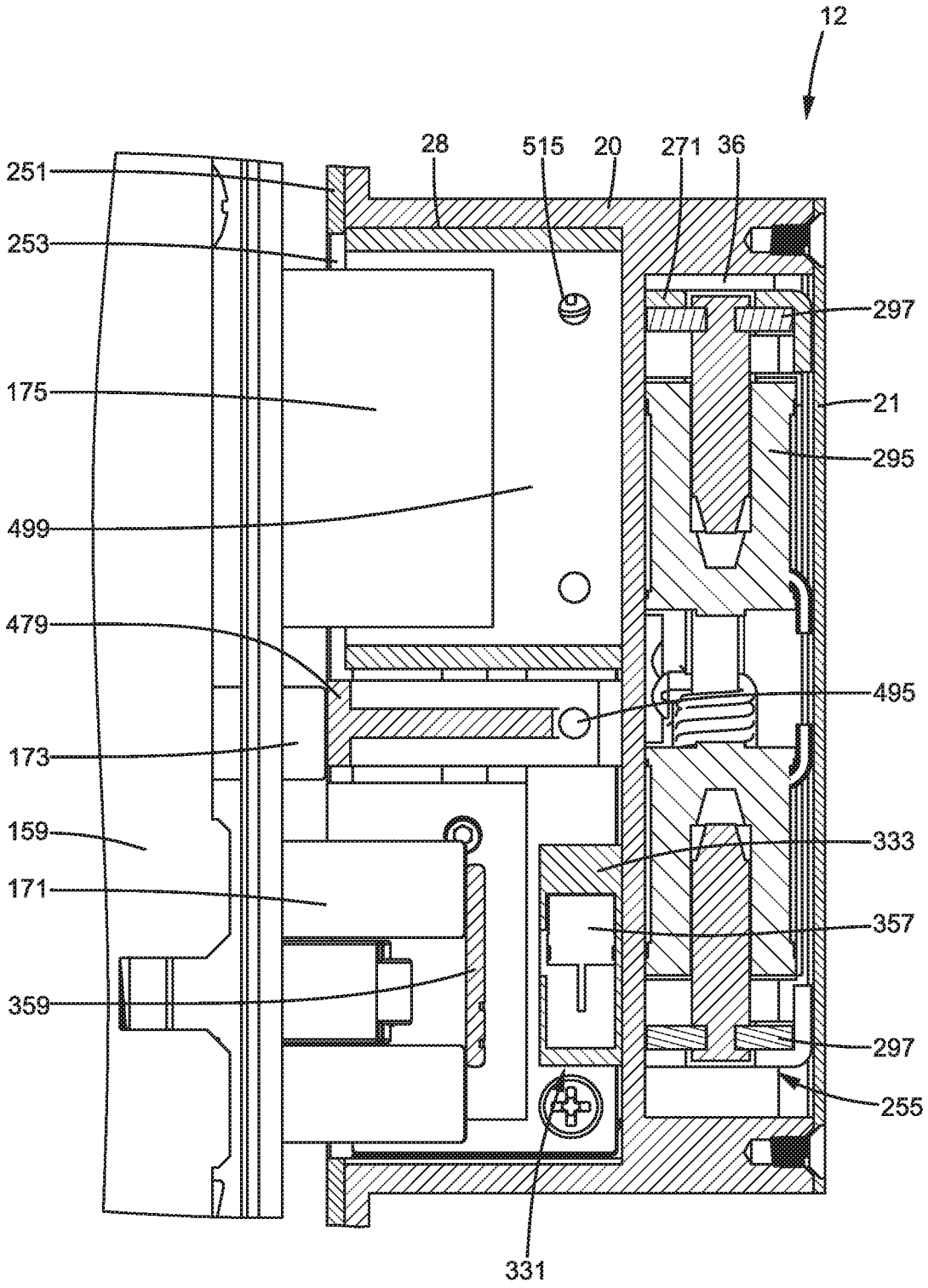
FIG. 22 is a cross sectional view taken along section line 22-22 of FIG. 21.

With reference to FIGS. 21 and 22, the latch control device 12 can be assembled into a third mode for cooperating with a second box type latch device 159. The second box type latch device 159 includes a second latch 171, a second anti-pick latch 173, and a locking latch 175 movable between an extended position and a retracted position. The second anti-pick latch 173 is located between the locking latch 175 and the second latch 171.

When the latch control device 12 is assembled into the third mode to cooperate with the second box type latch device 159, the first accessory 479 and the second accessory 497 are installed in the first compartment 28 of the mounting seat 20. In a case of the second accessory 497, two fixing screws 315 are used to extend from outside of the mounting seat 20 through the track 39 to threadedly couple with the two second screw holes 513. Then, the two fixing screws 315 are tightened to press the second accessory 497 against the inner surface of the mounting seat 20 for positioning purposes. Thus, the second accessory 497 is fixed in the first compartment 28 and near the upper end of the first compartment 28. Similarly, the first accessory 479 is fixed between the second accessory 497 and the detecting device 331. The second escutcheon 251 is installed on the front face 22 of the mounting seat 20. Thus, the second accessory 497 is aligned with the locking latch 175, the second anti-pick latch 173 is aligned with the first accessory 479, and the second latch 171 is aligned with the detecting device 331.

When the door is closed, the locking latch 175 is received in the locking latch hole 499 of the second accessory 497, the second anti-pick latch 173 is pressed by the first accessory 479 and retracts, and the second latch 171 is received in the first compartment 28.

Since the second accessory 497 is fixed in the first compartment 28, when the locking latch 175 is located in the locking latch hole 499 of the second accessory 497 (see FIG. 22), the locking latch 175 cannot pivot together with the door to disengage from the second accessory 497, such that even if the locking cap device 391 is set to the unlocking state, the second latch 171 cannot move the locking cap device 391 from the closure position to the non-closure position, thereby providing a locking function.

When the locking latch 175 of the second box type latch device 159 retracts and disengages from the locking latch hole 499 of the second accessory 497, if the locking cap device 391 is set in the locking state, the second latch 171 still cannot pivot the locking cap device 391 to the non-closure position outside of the first compartment 28, thereby providing a locking function.

When the locking latch 175 of the second box type latch device 159 retracts and disengages from the locking latch hole 499 of the second accessory 497, if the locking cap device 391 is set in the unlocked state, the second latch 171 can pivot the locking cap device 391 to the non-closure position outside of the first compartment 28, thereby providing an unlocking function.

The latch control device 12 can be used to electrically control opening of the door without replacing the original cylindrical latch device 139 or the original box type latch device 153, 159 by assembling the latch control device 12 into the first, second, or third mode, which can be achieved rapidly.

In the latch control device 12 according to the present invention, by using the fixing screws 315 having the second driving holes 319, the fixing screws 315 can be fixed by engaging a hand tool 593 with the second driving hole 319 of each fixing screw 315. Thus, the positions of the detecting device 311, the first accessory 479, the second accessory 497, and the third accessory 517 can be rapidly adjusted without detaching the latch control device 12 from the door, and the positions of the detecting device 311, the first accessory 479, the second accessory 497, and the third accessory 517 can be fixed in place after tightening the screw holes 315, providing excellent adjusting convenience during installation.

After moving the locking cap device 391 to the non-closure position, the latch control device 12 can be rapidly assembled to conform to the associated latch device by selective assembly, detachment, or adjustment of the position of the first accessory 479, the second accessory 497, and the third accessory 517.

The electric locking device 255 can be installed in the first position or the second position to rapidly set the electric latch control device 10 in a normally open state or a normally closed state.

As long as the two locking members 297 are in a position spaced from the first and second engaging portions 419 and 431, the locking cap device 391 can be manually moved to the non-closure position, such that the second driving hole 319 of each fixing screw 315 threadedly engaged with the first accessory 479, the second accessory 497, the third accessory 517, and the detecting device 331, can be exposed to permit easy coupling with the hand tool 593 for loosening each fixing screw 315, which allows minor adjustment of the first accessory 479, the second accessory 497, the third accessory 517, and the detecting device 331 to thereby cooperate with the corresponding cylindrical latch device 139, the first box type latch device 153, and the second box type latch device 159. Namely, the minor adjustment can be easily achieved.

When the two lower melting point members 573 melt due to a fire, the pins 575 couple with the pin holes 33 of the mounting seat 20. Even if the two locking members 297 move to a position spaced from the first and second coupling portions 419 and 431 and the locking latch 175 of the second box type latch device 159 disengages from the locking latch hole 499 of the second accessory 497, the locking cap device 391 cannot pivot from the closure position to the non-closure position. Thus assures the door will not open in any unexpected condition during the fire, reducing the spreading speed of the fire.

Now that the basic teachings of the present invention have been explained, many extensions and variations will be obvious to one having ordinary skill in the art. For example, the latch control device 12 can cooperate with a latch device other than the cylindrical latch device 139, the first box type latch device 153, and the second box type latch device 159. When the latch control device 12 is assembled into the second mode, a first box type latch device 153 (whose first latch 155 and first anti-pick latch 157 are arranged in different locations) can be used by adjusting the positions of the first accessory 479, the third accessory 517, and the detecting device 331 in the first compartment 28. Furthermore, when the latch control device 12 is assembled into the third mode, a second box type latch device 159 (whose second latch 171 and second anti-pick latch 159 are arranged in different locations) can be used by adjusting the positions of the second accessory 497, the third accessory 517, and the detecting device 331 in the first compartment 28.

Furthermore, the lock control device 12 can include only one high temperature locking device 551, only one driving member 295, and only one locking member 297. Furthermore, the locking cap device 391 can include only one tightening screw 459, and the locking cap 393 can include only one first coupling portion 419 and only one receiving hole 415. Furthermore, the first lining member 451 can include only one first screw hole 453, and the second lining member 471 can include only one second screw hole 477. Furthermore, the second accessory 497 can include only one second threaded hole 513 and only one second through-hole 515. Furthermore, the third accessory 517 can include only one third threaded hole 533 and only one third through-hole 535.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A latch control device comprising:

a mounting seat including a first side, a second side opposite to the first side, and a front face extending between the first side and the second side, wherein the mounting seat further includes a first compartment having a first opening in the front face and a second opening in the first side, and wherein the mounting seat further includes a track formed on the second side and intercommunicating with the first compartment;

a locking cap device pivotably connected to the mounting seat and fixably mounted to the mounting seat, wherein when the locking cap device is not fixed, the locking cap device is pivotable relative to the mounting seat between a closure position closing the second opening and a non-closure position not closing the second opening, and wherein when the locking cap device is fixed, the locking cap device is not pivotable from the closure position to the non-closure position;

a detecting device configured to detect whether a door is closed, wherein the detecting device includes a supporting seat, wherein the supporting seat includes an engaging portion and a sliding portion protruding from the engaging portion, wherein the sliding portion includes a screw hole, wherein the detecting device is received in the first compartment, and wherein the sliding portion is received in the track; and at least one fixing screw including a head and a shank, wherein the shank extends from the head and has an outer thread on an outer periphery thereof, wherein the head includes a first driving hole having non-circular cross sections, wherein the shank includes an end face having a second driving hole with non-circular cross sections, wherein the shank of the at least one fixing screw extends through the track and is in threading connection with the screw hole of the supporting seat, wherein when the locking cap device is in the closure position, the at least one fixing screw is prevented from being rotated by the second driving hole, wherein when the locking cap device is in the non-closure position, the at least one fixing screw is permitted to rotate by the second driving hole, wherein when the at least one fixing screw is tightened, the detecting device is fixed and not movable along the track, and wherein when the at least one fixing screw is loosened, the detecting device is movable along the track.

2. The latch control device as claimed in claim 1, further comprising:

a first accessory including opposite first and second sides, wherein a first sliding block is formed on the first side of the first accessory and includes a first threaded hole, wherein a first through-hole is defined in the second side of the first accessory and is aligned with the first threaded hole of the first accessory;

a second accessory including a second sliding block on a wall thereof, wherein the second sliding block includes a second threaded hole, wherein the second accessory further includes a second through-hole defined in another wall of the second accessory opposite to the second sliding block, and wherein the second threaded hole is aligned with the second threaded hole of the second accessory;

a third accessory including a third sliding block on a wall thereof, wherein the third sliding block includes a third threaded hole, wherein the third accessory further includes a third through-hole defined in another wall of the third accessory opposite to the third sliding block, and wherein the third threaded hole is aligned with the third threaded hole of the third accessory, wherein the at least one fixing screw includes a first fixing screw, a second fixing screw, and a third fixing screw, wherein the latch control device is selectively assembled into a first mode, a second mode, or a third mode to cooperate with a cylindrical latch device with a latch, a first box type latch device, or a second box type latch device, wherein the first box type latch device includes a first latch, a locking latch, and a first anti-pick latch operatively connected to the first latch, wherein the first latch is retractable when the first anti-pick latch is in an extended position, wherein the first latch is not retractable when the first anti-pick latch is in a retracted position, wherein the second box type latch device includes a second latch and a second anti-pick latch operatively connected to the second latch, wherein the second latch is retractable when the second anti-pick latch is in a retracted position, wherein the second latch is not retractable when the second anti-pick latch is in a retracted position, wherein when the latch control device is selectively assembled into the first mode, the first, second, and third accessories are not assembled, the latch of the cylindrical latch device is received in the first compartment of the mounting seat, wherein when the lock cap device is locked, the latch of the cylindrical latch device is prevented from disengaging from the first compartment, wherein when the locking cap device is unlocked, the latch head of the cylindrical latch device is operable to pivot the locking cap device from the closure position to the non-closure position and disengages from the first chamber, and wherein when the latch is in the first compartment, the detecting device detects the door is in the closed position, wherein when the latch control device is selectively assembled into the second mode, the first and third accessories are selected and mounted in the first compartment, the first sliding block of the first accessory and the third sliding block of the third accessory are received in the track, wherein the shank of the first fixing screw extends through the track and engages with the first threaded hole of the first accessory, wherein the shank of the third fixing screw extends through the track and engages with the third threaded hole of the third accessory, wherein the first accessory and the third accessory fill two portions of the first compartment, respectively, wherein the first compartment receives the first latch of the first box type latch device, wherein the first accessory is configured to press against and retract the first anti-pick latch, wherein when the locking cap device is locked, the first latch of the first box type latch device is prevented from disengaging from the first compartment, wherein when the locking cap device is unlocked, the first latch of the first box type latch device is operable to push the locking cap device to pivot from the closure position to the non-closure position and disengages from the first compartment, wherein when the locking cap device is in the closure position, the first and third fixing screws are prevented from being rotated by the second driving holes, wherein when the locking cap device is in the non-closure position, the first and third fixing screws are rotatable by using the second driving holes, wherein when the first and third fixing screws are tightened, the first and third accessories are fixed and, thus, not movable along the track, wherein when the first fixing screw is loosened, the first accessory is movable along the track, and wherein when the third fixing screw is loosened, the third accessory is movable along the track, wherein when the latch control device is selectively assembled into the third mode, the first and second accessories are selected and mounted in the mounting seat, wherein the first accessory blocks a portion of the first compartment, wherein the second accessory defines a locking latch hole, wherein the first sliding block of the first accessory and the second sliding block of the second accessory are received in the track, wherein the shank of the first fixing screw extends through the track and engages with the first threaded hole of the first accessory, wherein the shank of the second fixing screw extends through the track and engages with the second threaded hole of the second accessory, wherein the first compartment receives the second latch of the second box type latch device, wherein the first accessory is configured to press against and retract the second anti-pick latch, wherein the locking latch hole of the second accessory receives the locking latch of the second box type latch device, wherein when the locking cap device is locked, the second latch of the second box type latch device is prevented from disengaging from the first compartment, wherein when the locking cap device is unlocked and when the locking latch is located inside of the locking latch hole of the second accessory, the second latch of the second box type latch device is prevented from disengaging from the first compartment, wherein when the locking cap device is unlocked and when the locking latch is located outside of the locking latch hole of the second accessory, the second latch of the second box type latch device is operable to push the locking cap device to pivot from the closure position to the non-closure position and disengages from the first compartment, wherein when the locking cap device is in the closure position, the first and second fixing screws are prevented from rotating by using the second driving holes, wherein when the locking cap device is in the non-closure position, the first and third fixing screws are rotatable by using the second driving holes, wherein when the first and second fixing screws are tightened, the first and second accessories are fixed and, thus, not movable along the track, wherein when the first fixing screw is loosened, the first accessory is movable along the track, and wherein when the second fixing screw is loosened, the second accessory is movable along the track.

3. The latch control device as claimed in claim 1, wherein the locking cap device further includes:

a locking cap pivotably connected to the mounting seat and including an inner end, an outer end, and an inner surface extending between the inner side and the outer side, wherein the locking cap further includes a first groove defined in the inner surface and a second groove defined in the outer side and extending to the inner surface, a guiding plate including a first face, a second face opposite to the first face, and a guiding groove extending from the first face through the second face, wherein the guiding plate is fixed to the inner face of the locking cap, wherein the second face abuts the inner surface of the locking cap, wherein the guiding plate covers the first groove, wherein a portion of the guiding groove is aligned with a portion of the first groove to form a stepped portion, and wherein the guiding plate covers a side of the second groove to form another stepped portion;

a first lining member including a first coupling portion and a second coupling portion spaced from the first coupling portion, wherein the first lining member includes a first screw hole, a second lining member including a first engaging block and a second engaging block spaced from the first engaging block, and wherein the second lining member further includes a second screw hole, wherein one of the first lining member and the second lining member is selected and mounted, wherein when the first lining member is selected, the first lining member abuts against the first face of the guiding plate, wherein the first coupling portion extends into the guiding groove and engages with the first groove, wherein the second coupling portion extends into the second groove, a tightening screw is threadedly engaged with the first screw hole and presses against the inner surface of the locking cap, wherein when the second lining plate is selected, the second lining plate abuts the first face of the guiding plate, wherein the first engaging block extends into the guiding groove and engages with the first groove, wherein the second engaging block extends into the second groove, the tightening screw is threadedly engaged with the second screw hole and presses against the inner surface of the locking cap, wherein a spacing between an outer surface of the second lining member and the first face of the guiding plate is smaller than a spacing between an outer surface of the first lining member and the first face of the guiding plate.

4. The latch control device as claimed in claim 1, further comprising:

a higher melting point member including an outer end, an inner end, a larger hole section extending from the inner end towards but spaced from the outer end, and a smaller hole section extending from the outer end to the larger hole section, wherein the locking cap further includes a receiving hole in a side thereof, wherein the higher melting point member is securely received in the receiving hole, wherein the mounting seat further includes a pin hole in a side thereof and intercommunicating with the first compartment, wherein the receiving hole is aligned with the pin hole when the locking cap device is in the closure position;

a lower melting point member received in the larger hole section and having a melting point lower than a melting point of the higher melting point member;

a pin movably received in the larger hole section, wherein the pin is stopped by the lower melting point member, and wherein the pin includes a coupling end and an enlarged end larger than the coupling end; and an ejection spring received in the receiving hole, wherein the ejection spring biases the pin towards the pin hole, wherein when the coupling end of the pin is not engaged with the pin hole, the locking cap device is pivotable towards the non-closure position, and wherein when the lower melting point member melts under high heat, the ejection spring moves the coupling end of the pin to pass through the smaller hole section and engages with the pin hole, and the locking cap device is prevented from pivoting towards the non-closure position.

* * * * *